US005464732A

United States Patent [19]

Kida et al.

[11] Patent Number: 5,464,732

[45] Date of Patent: Nov. 7, 1995

[54] SILVER HALIDE COLOR PHOTOGRAPHIC LIGHT-SENSITIVE MATERIAL

[75] Inventors: Shuji Kida; Yukio Oya; Akiyoshi Tai, all of Odawara, Japan

[73] Assignee: Konica Corporation, Japan

[21] Appl. No.: 253,092

[22] Filed: Jun. 2, 1994

[30] Foreign Application Priority Data

Jun. 19, 1993 [JP] Japan ..... 5-134741

[51] Int. Cl.[6] ..... G03C 7/36; G03C 7/392

[52] U.S. Cl. ..... 430/505; 430/551; 430/557

[58] Field of Search ..... 430/556, 557, 430/551, 505

[56] References Cited

U.S. PATENT DOCUMENTS

| | | | |
|---|---|---|---|
| 4,988,613 | 1/1991 | Ohki et al. | 430/551 |
| 4,992,360 | 2/1991 | Tsuruta et al. | 430/557 |
| 5,208,140 | 5/1993 | Nishijima | 430/551 |
| 5,215,877 | 6/1993 | Tomotake et al. | 430/557 |
| 5,217,857 | 6/1993 | Hayashi | 430/557 |
| 5,219,716 | 6/1993 | Takada et al. | 430/557 |

FOREIGN PATENT DOCUMENTS

| | | | |
|---|---|---|---|
| 384487 | 8/1990 | European Pat. Off. | G03C 7/30 |
| 542463 | 5/1993 | European Pat. Off. | G03C 1/30 |
| 2406087 | 8/1974 | Germany | G03C 7/26 |
| 2724488 | 12/1977 | Germany | G03C 7/26 |
| 1002151 | 1/1986 | Japan | 430/551 |
| 3286848 | 11/1988 | Japan | 430/551 |
| 157646 | 7/1991 | Japan . | |

*Primary Examiner*—Lee C. Wright

*Attorney, Agent, or Firm*—Jordan B. Bierman; Bierman and Muserlian

[57] ABSTRACT

A silver halide color photographic light-sensitive material is disclosed. The light-sensitive material comprises a support having thereon a plurality of silver halide emulsion layers, wherein a silver halide emulsion layer arranged at the position nearest to the support among said silver halide emulsion layers contains a dye-forming coupler and a color stain preventing agent represented by Formula HQ-1 in an amount of 1 mol % to 5 mol % of the dye-forming coupler.

(HQ-I)

wherein $R^1$, $R^2$, $R^3$ and $R^4$ are each independently a hydrogen atom, a halogen atom or a specified substituent, provided that at least one of $R^1$, $R^2$, $R^3$ and $R^4$ is a group having 6 or more carbon atoms in total.

4 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more particularly to a silver halide color photographic light-sensitive material having excellent color forming characteristics, capable of forming an image excellent in the permanency, and improved so as to be free of color fog.

BACKGROUND OF THE INVENTION

In the silver halide color photographic light-sensitive material, as the dye image forming agents therefor, yellow, magenta and cyan couplers are usually used in combination. These couplers are required to have basic performance characteristics such as color-forming characteristics, storage stability, resulting image's color reproduction quality, and image keeping quality. Particularly, in the color photographic light-sensitive material to be provided for direct appreciation, such as color photographic paper, since importance is attached to white background, it is required for the paper to inhibit color stain such as color fog to the utmost.

In order to inhibit the color fog, an antistain agent such as a hydroquinon derivative is used. The oxidation product of a developing agent that has been produced for some reason in an unexposed area of the light-sensitive material, before coming into its coupling reaction with a coupler, is subjected to scavenge treatment with the antistain agent, whereby the occurrence of color fog can be inhibited. As is predicted from such the mechanism, if the antistain agent is used in plenty, it would impair the color-forming characteristics of the coupler, bringing about problems of the maximum density drop and contrast reduction. The excessive use of the antistain agent causes a problem of deteriorating the dye image's resistance to light as described in Japanese Patent Publication Open to Public Inspection (hereinafter abbreviated to JP O.P.I.) No. 275261/1987. Thus, an attempt made to efficiently prevent the occurrence of color fog is forced into dilemma by causing at the same time the lowering of the maximum density and deterioration of the resistance to light.

SUMMARY OF THE INVENTION

It is therefore an object of the invention to provide a silver halide color photographic light-sensitive material which is efficiently improved to be free of color fog to provide an excellent color image finish without lowering its maximum density or deteriorating its image keeping quality.

The silver halide color photographic light-sensitive material of the invention comprises a support having thereon a plurality of silver halide emulsion layers, in which the silver halide emulsion layer provided at the position closest to the support among these silver halide emulsion layers contains a dye-forming coupler and a compound represented by Formula HQ-1 in an amount of 1 mol % to 5 mol % of the dye-forming coupler.

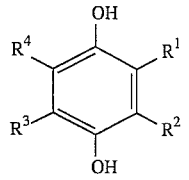

(HQ-I)

wherein $R^1$, $R^2$, $R^3$ and $R^4$ are each independently a hydrogen atom, a halogen atom, an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkoxycarbonyl group, an aryloxycarbonyl group, an alkylacyloxy group or an arylacyloxy group, the above groups represented by $R^1$, $R^2$, $R^3$ or $R^4$ may have a substituent, provided that at least one of $R^1$ and $R^3$ is a group having 6 or more carbon atoms in total including the substituent thereof.

DETAILED DESCRIPTION OF THE INVENTION

As a result of our careful investigation about the proportion by weight of the antistain agent to the coupler, it has now been found that the color light-sensitive material can be sufficiently prevented from fogging without causing deterioration of its resulting image keeping quality or lowering of its maximum density by having the light-sensitive silver halide emulsion layer closest to the support contain the antistain agent in a specific proportional amount range to the coupler.

In a silver halide emulsion layer located far from the support, the antistain agent, if its amount is reduced to get in the range of the invention, can not sufficiently inhibit the emulsion from fogging. The reason is not certain, but it is probably because, in a rapid processing, since a developing solution takes time to permeate into the light-sensitive material, the developing of the light-sensitive silver halide emulsion layer closest to the support begins later than that of other silver halide emulsion layers, and therefore the antistain agent, even when used in a reduced amount, can sufficiently inhibit the emulsion from fogging, whereby the above dilemma can be solved.

The antistain agent used in the color light-sensitive material of the invention is a compound represented by the following Formula HQ-I:

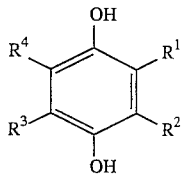

Formula HQ-I wherein $R^1$, $R^2$, $R^3$ and $R^4$ each represent a hydrogen atom, a halogen atom, an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkoxycarbonyl group, an aryloxycarbonyl group, an alkylacyloxy group or an arylacyloxy group.

In the above atoms or groups represented by $R^1$, $R^2$, $R^3$ or $R^4$, the halogen atom is such as, e.g., fluorine, chlorine or bromine, and the alkyl group is such as, e.g., methyl,-ethyl, propyl, i-propyl, butyl, t-butyl, amyl, i-amyl, octyl, dodecyl or octadecyl, and preferably an alkyl group having 1 to 32 carbon atoms.

The alkenyl group is such as, e.g., allyl, octenyl or oleyl, and preferably an alkenyl group having 2 to 32 carbon atoms.

The aryl group is such as phenyl or naphthyl.

The acyl group is such as acetyl, octanoyl or lauroyl.

The cycloalkyl group is, e.g., cyclohexyl or cyclopentyl.

The alkoxy group is, e.g., methoxy, ethoxy or dodecyloxy; the aryloxy group is, e.g., phenoxy; the alkylthio group is, e.g., methylthio, butylthio or dodecylthio; the arylthio group is, e.g., phenylthio; the alkylacylamino group is, e.g., acetylamino; the arylacylamino group is, e.g., benzoylamino; the alkylcarbamoyl group is, e.g., methylcarbamoyl; the arylcarbamoyl group is, e.g., phenylcarbamoyl; the alkylsulfonamido group is, e.g., methylsulfonamido; the arylsulfonamido group is, e.g., phenylsulfonamido; the alkylsulfamoyl group is, e.g., methylsulfamoyl; the arylsulfamoyl group is, such as, phenylsulfamoyl; the alkylsulfonyl group is, e.g., methylsulfonyl; the arylsulfonyl group is, e.g., phenylsulfonyl; the alkyloxycarbonyl group is, e.g., methyloxycarbonyl; the aryloxycarbonyl is, e.g., phenyloxycarbonyl; the alkylacyloxy group is, e.g., acetyloxy; and the arylacyloxy group is, e.g., benzoyloxy.

These groups mentioned above include those having substituents. Examples of the substituent include alkyl, aryl, aryloxy, alkylthio, cyano, acyloxy, alkoxycarbonyl, acyl, sulfamoyl, hydroxyl, nitro, amino and heterocyclic groups.

At least one of the groups represented by $R^1$ and $R^3$ is a group in which the total number of its carbon atoms including those of its substituent described above is not less than 6.

The particularly preferred among the compounds represented by Formula HQ-I are those having the following Formula HQ-II.

Formula HQ-II

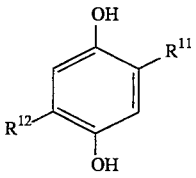

wherein $R^{11}$ and $R^{12}$ each represent a hydrogen atom, an alkyl group, an alkenyl group, an aryl group, an acyl group or a cycloalkyl group, provided at least either one of $R^{11}$ and $R^{12}$ is a group in which the total number of its carbon atoms is not less than 6.

The alkyl group represented by $R^{11}$ or $R^{12}$ is, e.g., methyl, ethyl, propyl, i-propyl, butyl, t-butyl, amyl, i-amyl, octyl, dodecyl or octadecyl, and most preferably an alkyl group having 1 to 32 carbon atoms.

The alkenyl group is, e.g., allyl, octenyl or oleyl, and preferably an alkenyl group having 2 to 32 carbon atoms.

The aryl group is such as phenyl or naphthyl.

The acyl group is, e.g., acetyl, octanoyl or lauroyl; the cycloalkyl group is, e.g., cyclohexyl or cyclopentyl; and the heterocyclic group is, e.g., imidazolyl, furyl, pyridyl, triazinyl or thiazolyl.

In Formula HQ-II, at least either one of $R^{11}$ and $R^{12}$ is a group in which the total number of its carbon atoms is preferably not less than 8, more preferably both of $R^{11}$ and $R^{12}$ are groups each having 8 to 18 carbon atoms in total, and most preferably they are the same alkyl groups each having in total 8 to 18 carbon atoms.

Examples of the compound Of Formula HQ-I, used in the invention, are given below.

HQ-1

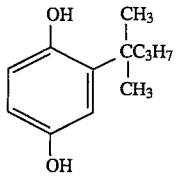

HQ-2

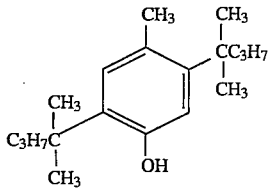

HQ-3

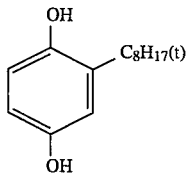

HQ-4

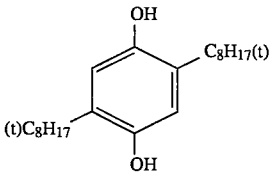

HQ-5

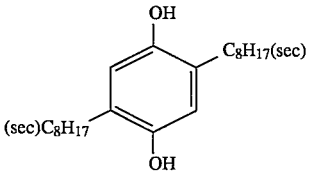

HQ-6

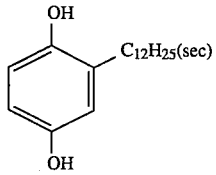

HQ-7

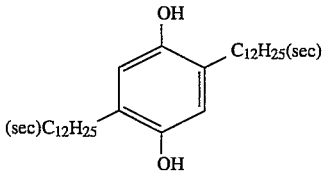

-continued
HQ-8
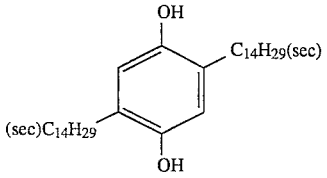
HQ-9
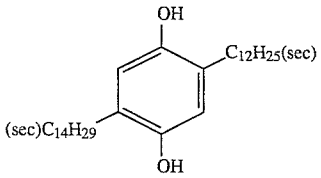
HQ-10
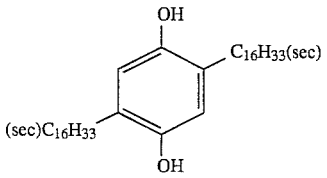
HQ-11
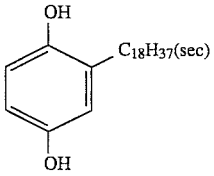
HQ-12
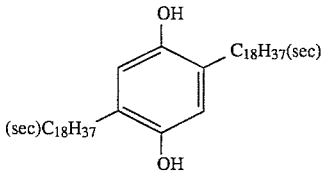
HQ-13
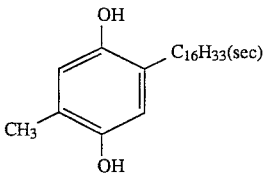
HQ-14
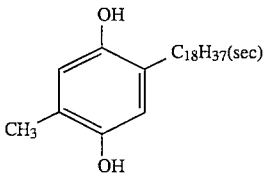
HQ-15
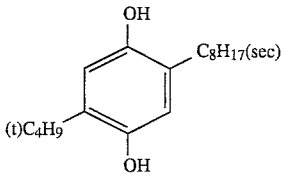
HQ-16
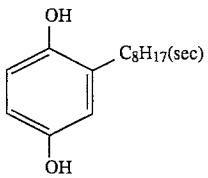
-continued
H-17
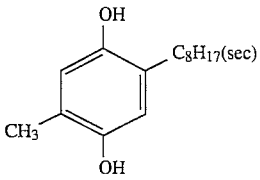
H-18
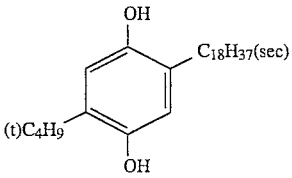
HQ-19
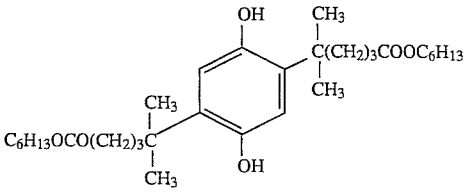
HQ-20
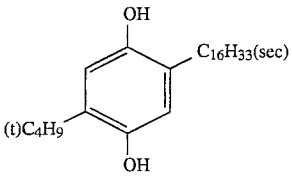
HQ-21
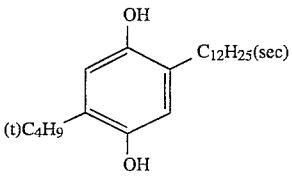
HQ-22
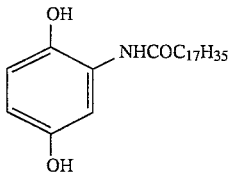
HQ-23
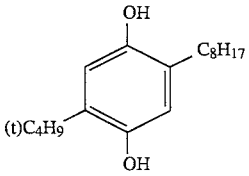
HQ-24
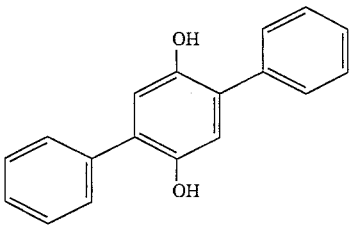

-continued

HQ-25

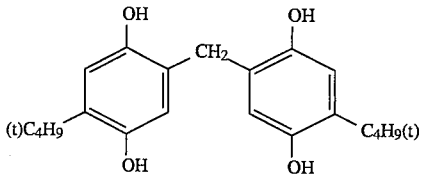

HQ-26

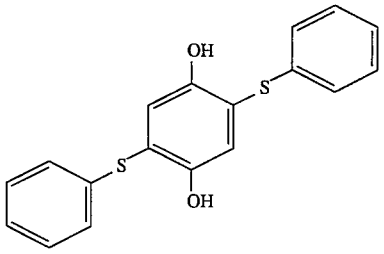

HQ-27

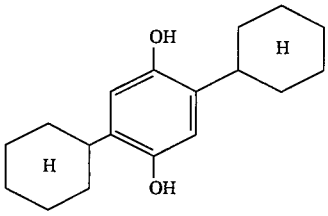

HQ-28

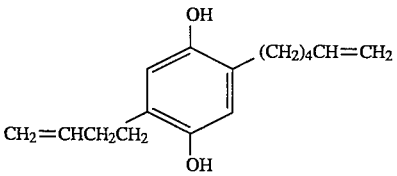

HQ-29

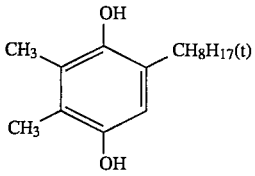

HQ-30

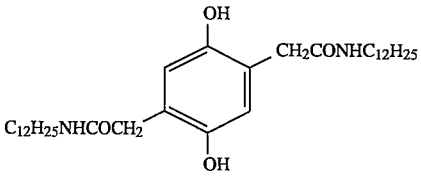

HQ-31

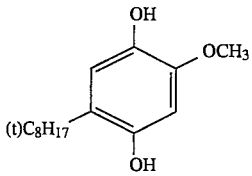

HQ-32

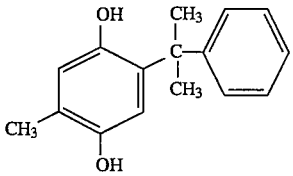

-continued

HQ-33

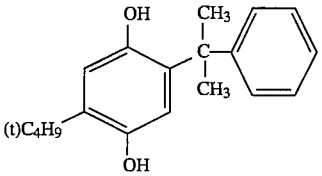

HQ-34

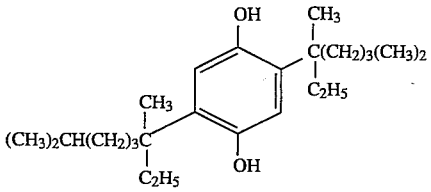

HQ-35

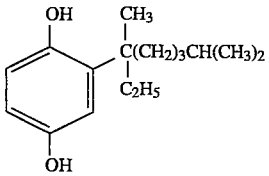

HQ-36

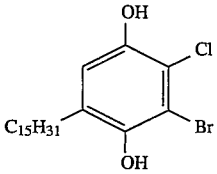

In the invention, the coupler contained in the light-sensitive silver halide emulsion layer closest to the support may be any one of a yellow coupler, a magenta coupler or a cyan coupler, but is preferably a yellow coupler.

As the yellow coupler there may be suitably used various acylacetanilide couplers, among which benzoylacetanilide and pivaloylacetanilic compounds are advantageous; particularly those couplers represented by the following Formula I are preferred.

Formula I

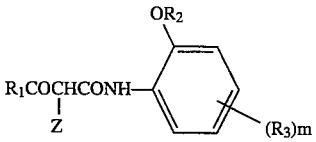

wherein $R_1$ is an alkyl group or a cycloalkyl group; $R_2$ is an alkyl group, a cycloalkyl group or an aryl group; $R_3$ is a group substitutable to the benzene ring; m is an integer of 0 to 4, provided when m is 2 or more, the $R_3$s may be either the same or different; and Z is a hydrogen atom or a group capable of splitting off at the time of the compound's coupling reaction with the oxidation product of a developing agent.

The coupler represented by Formula I is described in detail.

The alkyl group represented by $R_1$ is a straight-chain or branched-chain alkyl group such as methyl, ethyl, i-propyl, t-butyl, dodecyl, 1-hexylnonyl. The cycloalkyl group represented by $R_1$ is, e.g., cyclopropyl, cyclohexyl or adamantyl.

These alkyl and cycloalkyl groups represented by $R_1$ may each have a substituent. Examples of the substituent include a halogen atom such as chlorine, bromine; a cyano group, a nitro group, an aryl group such as phenyl, p-t-octylphenyl, 2,4-di-t-amylphenyl, a hydroxyl group; an alkoxy group such as methoxy, 2-ethoxy; an aryloxy group such as phenoxy, 2,4-di-t-amylphenoxy, 4-(4-hydroxyphenylsulfonyl)phenoxy; a heterocyclic oxy group such as 4-pyridyloxy, 2-hexahydropyranyloxy; a carbonyloxy group including an alkylcarbonyloxy group such as acetyloxy, pivaloyloxy, and an arylcarbonyloxy group such as benzoyloxy; a sulfonyloxy group including an alkylsulfonyloxy group such as methanesulfonyloxy, trifluoromethanesulfonyloxy, dodecanesulfonyloxy, and an arylsulfonyloxy such as benzenesulfonyloxy, p-toluenesulfonyloxy; a carbonyl group including an alkylcarbonyl group such as acetyl, pivaloyl, and an arylcarbonyl group such as benzoyl, 3,5-di-t-butyl-4-hydroxybenzoyl; an oxycarbonyl group including an alkoxycarbonyl group such as methoxycarbonyl, cyclohexyloxycarbonyl, dodecyloxycarbonyl, an aryloxycarbonyl group such as 2,4-di-t-amylphenoxycarbonyl, and a heterocyclic oxycarbonyl group such as 2-pyridyloxycarbonyl, 1-phenylpyrazolyl-5-oxycarbonyl; a carbamoyl group including an alkylcarbamoyl group such as dimethylcarbamoyl, 4-(2,4-di-t-amylphenoxy)butylcarbamoyl, and an arylcarbamoyl group such as phenylcarbamoyl, 1-naphthylcarbamoyl; a sulfonyl group including an alkylsulfonyl group such as methanesulfonyl, trifluoromethanesulfonyl, and an arylsulfonyl group such as p-toluenesulfonyl; a sulfamoyl group including an alkylsulfamoyl group such as dimethylsulfamoyl, 4-(2,4-di-t-amylphenoxy)butylsulfamoyl, an arylsulfamoyl group such as phenylsulfamoyl, and an acylsulfamoyl group such as acetylsulfamoyl, ethylcarbonylsulfamoyl; an amino group including an alkylamino group such as dimethylamino, cyclohexylamino, dodecylamino, and an arylamino group such as anilino, p-t-octylanilino; a sulfonamido group including an alkylsulfonamido group such as methanesulfonamido, heptafluoropropanesulfonamido, hexadecylsulfonamido, and an arylsulfonamido group such as p-toluenesulfonamido, pentafluorobenzenesulfonamido; an acylamino group including an alkylcarbonylamino group such as acetylamino, myristoylamino, and an arylcarbonylamino group such as benzoylamino; an alkylthio group such as methylthio, t-octylthio; an arylthio group such as phenylthio; and a heterocyclic thio group such as 1-phenyltetrazole-5-thio, 5-methyl-1,3,4-oxadiazole-2-thio.

$R_1$ is preferably an alkyl group, more preferably a branched-chain alkyl group, and most preferably t-butyl.

The alkyl groups and cycloalkyl groups represented by $R_2$ in Formula I may be the same as those defined for the foregoing $R_1$. The aryl group represented by $R_2$ is, e.g., phenyl or 1-naphthyl. The alkyl, cycloalkyl or aryl group represented by $R_2$ may have a substituent. Examples of the substituent include the same alkyl and cycloalkyl groups as defined for $R_1$ and the same groups defined as the substituent to the alkyl and cycloalkyl groups of $R_1$.

$R_2$ is preferably an alkyl group, more preferably a non-substituted alkyl group, and most preferably methyl.

In Formula I, as the substituent to the benzene ring represented by $R_3$ there may be applied those defined as the substituent to the alkyl, cycloalkyl and aryl groups represented by the foregoing $R_2$.

$R_3$ is preferably an acylamino group, a sulfonylamino group, an oxycarbonyl group or a sulfamoyl group. m is an integer of 0 to 4, but is preferably 1.

In Formula I, Z, the group capable of splitting off at the time of the compound's coupling reaction with the oxidation product of a developing agent, includes those having the following Formulas II, III and IV:

$$-OR_4 \qquad \text{Formula II}$$

$$-O-\overset{\overset{\displaystyle O}{\|}}{C}-R_4 \qquad \text{Formula III}$$

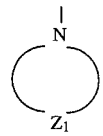

Formula IV

In Formulas II and III, $R_4$ represents an alkyl group, a cycloalkyl group, an aryl group or a heterocyclic group. These alkyl, cycloalkyl and aryl groups represented by $R_4$ are the same as those defined for the $R_2$ in the foregoing Formula I. As the heterocyclic group represented by $R_4$ there are 4-pyridyl and 2-hexahydropyranyl. The alkyl, cycloalkyl, aryl and heterocyclic groups represented by $R_4$ may each have a substituent. Examples of the substituent include those defined as the substituent for the alkyl, cycloalkyl and aryl groups represented by $R_2$ in Formula I.

Of these alkyl, cycloalkyl, aryl and heterocyclic groups represented by $R_4$, the preferred is the aryl group. The preferred as the substituent to $R_4$ are electron-attractive groups including an oxycarbonyl group such as carboxyl, methoxycarbonyl or i-propyloxycarbonyl; an acyl group such as acetyl or benzoyl; a sulfonyl group such as trifluoromethanesulfonyl or 4-hydroxyphenylsulfonyl; a nitro group, a cyano group, a halogen atom; a sulfamoyl group such as dimethylsulfamoyl; an acylamino group such as acetylamino or pentafluorobenzoyl; and a sulfonamido group such as methanesulfonamido.

In Formula IV, $Z_1$ represents a group of nonmetallic atoms necessary to form a 5- or 6-member ring in cooperation with the nitrogen atom, wherein the atomic group unit necessary to form a group of nonmetallic atoms includes, e.g., methylene, methine, substituted methine, —C(O)—, —N($R_5$)—, wherein $R_5$ is a hydrogen atom, an alkyl group, an aryl group or a heterocyclic group, —N=, —O— and —S(O)$_u$—, wherein u is an integer of 0 to 2.

The preferred among the compounds represented by Formula I are those having the following Formula V:

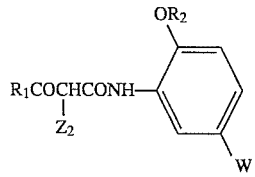

Formula V wherein $R_1$ and $R_2$ are as defined for the $R_1$ and $R_2$, respectively, in the foregoing Formula I; $Z_2$ is as defined for the Z of Formula I; and W represents a group having the following Formula VI:

$$-NH-X-(L-Y)_n-R_6 \qquad \text{Formula VI}$$

wherein X represents a carbonyl group or a sulfonyl group, and preferably a carbonyl group; L represents an alkylene group or an arylene group; e.g., a straight-chain or branched-chain alkylene group (such as methylene, ethylene, 2,3-propylene, 1,2-cyclohexylene), a 1,4-phenylene group, a 1,2-naphthylene group, a 9,10-anthranylene group; the preferred among these is an alkylene group having 1 to 6 carbon atoms;

Y represents a divalent linkage group, such as a sulfinyl group, a sulfenyl group, a sulfonyl group, a sulfamoyl group, a carbonyl group, a carbonyloxy group, a carbamoyl group, an oxy group, an oxycarbonyl group, an amino group, an acylamino group, a sulfonamido group; the preferred among these linkage groups are the sulfonyl, sulfamoyl, carbonyloxy, carbamoyl, oxy, oxycarbonyl and acylamino groups, and the most preferred are the sulfonyl, oxy, oxycarbonyl and carbamoyl groups;

n is an integer of 0 or 1; and $R_6$ is an alkyl group, a cycloalkyl group or an aryl group.

The alkyl, cycloalkyl and aryl groups represented by $R_6$ are as defined for the $R_2$ in the foregoing Formula I. The alkyl, cycloalkyl and aryl groups may each have a substituent; examples of the substituent are the same as those to the alkyl, cycloalkyl and aryl groups represented by the $R_2$ of Formula I.

The substituent represented by $Z_2$ in the foregoing Formula V is preferably a substituent represented by the following Formula VII, VIII, IX, X, XI or XII.

Formula VII

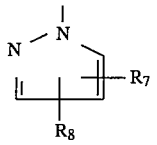

Formula VIII

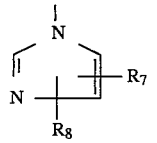

Formula IX

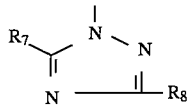

Formula X

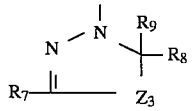

Formula XI

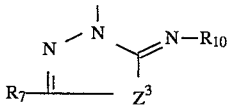

Formula XII

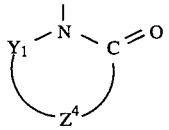

In Formulas VII, VIII, IX, X and XI, $R_7$, $R_8$ and $R_9$ each represent a group substitutable to the azole ring, and examples of the group include those applicable as the substituent to the alkyl, cyloalkyl and aryl groups represented by the $R_2$ of the foregoing Formula I.

In Formula XI, $R_{10}$ represents the same alkyl, cycloalkyl or aryl group as those defined for the $R_4$ of the foregoing Formulas II and III, a carbonyl group or a sulfonyl group.

In Formulas X and XI, $Z_3$ represents —N($R_{11}$)—, wherein $R_{11}$ is as defined for the $R_5$ of Formula IV, —O— or —S(O)v—, wherein v is an integer of 0 to 2.

In Formula XII, $Y_1$ represents —N($R_{12}$)—, wherein $R_{12}$ is as defined for the $R_5$ of Formula IV, a hetero atom such as —O— or —S(O)r—, wherein r is an integer of 0 to 2, or a carbon atom for constituting groups such as —C(O)—, —C($R_{13}$)($R_{14}$)—, wherein $R_{13}$ and $R_{14}$ each represent a hydrogen atom or the same group as the substituent to the alkyl, cycloalkyl or aryl group represented by the $R_2$ of Formula I, and —C($R_{15}$)—, wherein $R_{15}$ represents a hydrogen atom of the same group as the substituent to the alkyl, cycloalkyl or aryl group represented by the $R_2$ of Formula I.

In Formula XII, $Z_4$ represents a group of nonmetallic atoms necessary to form a 5- or 6-member ring in cooperation with the —$Y_1$—N—CO—, wherein the atomic group unit necessary to form a group of nonmetallic atoms is as defined for the $Z_1$ of Formula IV.

Among the compounds represented by Formula V the preferred are those represented by the following Formula XIII:

Formula XIII

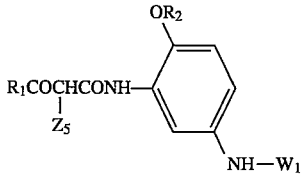

wherein $R_1$ and $R_2$ are as defined for the $R_1$ and $R_2$, respectively, of the foregoing Formula I; and $Z_5$ represents the same group as in the above Formula [XII], but is a group having a molecular weight of not more than 235 in the state of being represented by the following Formula XII', namely, in the hydrogen-added state of $Z_5$ that has been split off from a compound of Formula XIII upon its reaction with the oxidation product of a developing agent.

Formula XII'

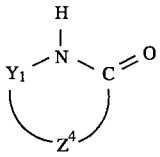

wherein $W_1$ is a group represented by the following Formula XIV, XV or XVI:

Formula XIV

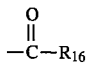

Formula XV

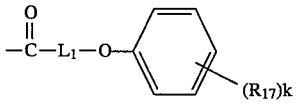

Formula XVI

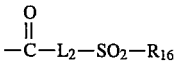

In Formulas XIV and XVI, $R_{16}$ represents an alkyl group or a cycloalkyl group, examples of which include the same alkyl and cycloalkyl groups as those for the $R_1$ of the foregoing Formula I. The alkyl and cycloalkyl groups represented by $R_{16}$ may each have a substituent, and as the substituent there are applicable those defined as the substituent to the alkyl, cycloalkyl and aryl groups represented by the $R_2$ of Formula I. The preferred among these alkyl and cycloalkyl groups represented by $R_{16}$ is a nonsubstituted alkyl group.

In Formula XV, $R_{17}$ represents a group substitutable to the benzene ring, and examples of the group include those as the substituent to the alkyl, cycloalkyl and aryl groups represented by the $R_2$ of Formula I; $R_{17}$ is preferably a nonsubstituted alkyl group, more preferably a nonsubstituted branched-chain alkyl group, and most preferably a nonsubstituted branched-chain alkyl group having 3 to 12 carbon atoms; and k is an integer of 0 to 5, provided when k is 2 or more, the $R_{17}$s may be either the same as or different from one another, and k is preferably 2.

In Formulas XV and XVI, $L_1$ and $L_2$ each represent an alkylene group, examples of which include those defined as the alkylene group represented by the L of Formula VI; $L_1$ is preferably an alkylene group having 3 to 7 carbon atoms, more preferably 1,3-propylene, 1,1-propylene, 1,1-pentylene or 1,1-hexylene, and most preferably 1,3-propylene or 1,1-propylene; and $L_2$ is preferably an alkylene having 3 to 7 carbon atoms, more preferably 1,3-propylene, 2,2-propylene, 2,3-propylene or 1,1-propylene, and most preferably 1,3-propylene or 2,3-propylene.

The preferred among the compounds represented by Formula XIII are those having the following Formula XVII:

Formula XVII

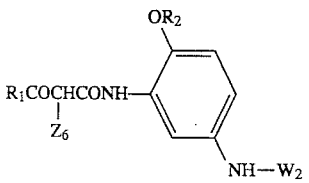

wherein $R_1$ and $R_2$ are as defined for the $R_1$ and $R_2$, respectively, of Formula I.

In Formula XVII, $W_2$ is a group represented by the following Formula XVIII or XIX:

Formula XVIII

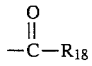

Formula XIX

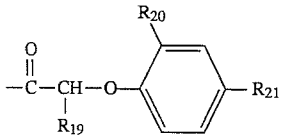

In Formula XVIII, $R_{18}$ is a straight- or branched-chain nonsubstituted alkyl group having 11 to 21 carbon atoms.

In Formula XIX, $R_{19}$ is a hydrogen atom or a straight- or branched-chain nonsubstituted alkyl group having 1 to 6 carbon atoms, preferably ethyl, butyl or hexyl; and $R_{20}$ or $R_{21}$ each respresent a hydrogen atom or a branched-chain alkyl group having 4 to 12 carbon atoms, provided the total number of carbon atoms of $R_{20}$ and $R_{21}$ is 4 to 16.

In Formula XVII, $Z_6$ represents the same group as that in the foregoing Formula XII, but is a group having a molecular weight of not more than 160 in the state of having the foregoing Formula XII', i.e., in the hydrogen-added state of $Z_6$ that has been split off from the compound having Formula XVII upon its reaction with the oxidation product of a developing agent.

The preferred among the compounds represented by Formula XVII are those represented by the following Formula XX:

Formula XX

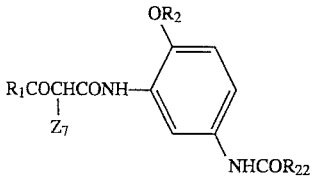

wherein $R_1$ and $R_2$ are as defined for the $R_1$ and $R_2$, respectively, of the foregoing Formula I; $R_{22}$ is a straight-chain non-substituted alkyl group having 11 to 21 carbon atoms; and $Z_7$ represents the same group as that in the foregoing Formula XII, but is a group having a molecular weight of not more than 128 in the state of being represented by Formula XII, i.e., in the hydrogen-added state of $Z_7$ that has been split off from the compound having Formula XX upon its reaction with the oxidation product of a developing agent.

The two-equivalent yellow coupler represented by Formula I may exert a reaction for coupling at any substituent thereof to form a bis-, tris-, tetrakiss- or polymer-type product.

The yellow coupler represented by Formula I can be easily synthesized, using a commercially available compound as a starting material, according to a conventional method, such as one of those methods as described in JP O.P.I. Nos. 125047/1988 and 224661/1992.

The following are examples of the split-off group Z in Formula I of the invention. The parenthesized indication underneath each of the following listed formulas is the molecular weight of the hydrogen-added group Z that was split off from the compound of Formula I upon its reaction with the oxidation product of a developing agent.

(A:128)

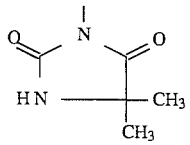

(B:128)

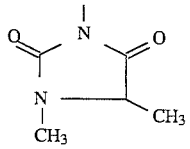

(C:114)

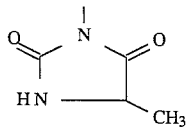

(D:114)

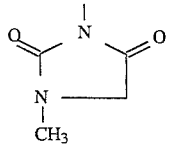

(E:100)

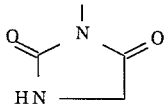

(F:101)

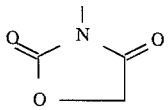

(G:115)

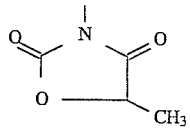

-continued
(H:129)
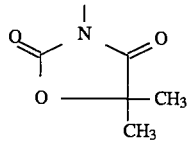
(I:131)
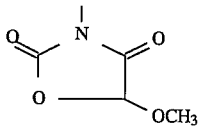
(J:144)
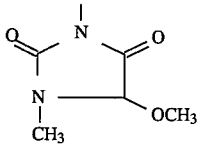
(K:170)
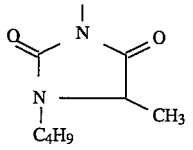
(L:190)
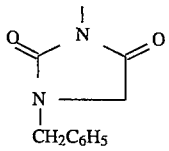
(M:234)
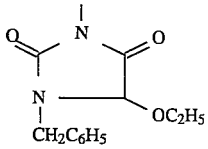
(N:214)
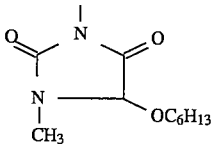
(O:115)
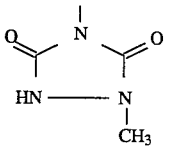
(P:177)
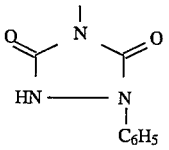
(Q:233)
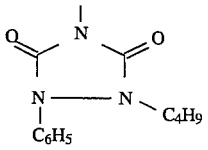
-continued
(R:267)
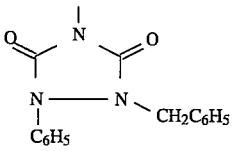
(S:176)
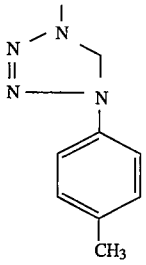
(T:125)
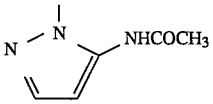
(U:154)
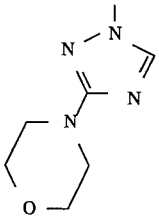
(V:196)
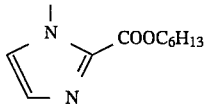
(W:187)
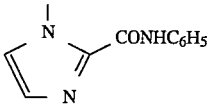
(X:297)
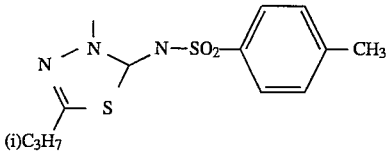
(Y:180)
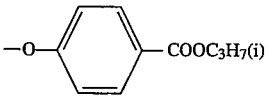
(Z:340)
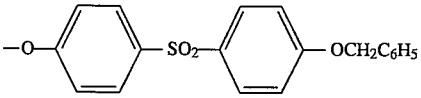
(α:153)
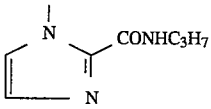
The following are examples of the substituent $R_3$ in Formula I of the invention.
$-NHCOC_{11}H_{23}(n)$ (a)

-continued $-NHCOC_{13}H_{27}(n)$ (b)

$-NHCOC_{15}H_{31}(n)$ (c)

$-NHCOC_{17}H_{35}(n)$ (d)

$-NHCOC_{19}H_{39}(n)$ (e)

$-NHCOC_{21}H_{43}(n)$ (f)

$-NHCOCHC_8H_{17}(n)$ (g)
$\quad\quad |$
$\quad C_6H_{13}(n)$ (h)

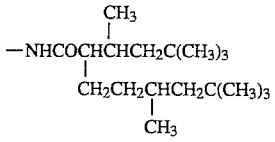

(i)

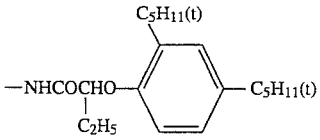

(j)

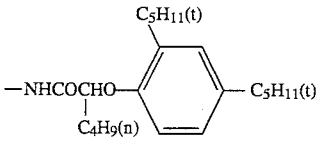

(k)

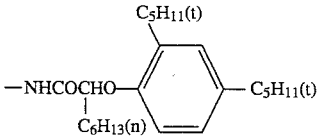

(l)

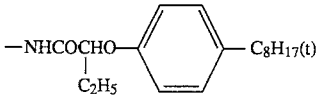

(m)

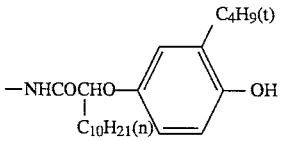

(n)

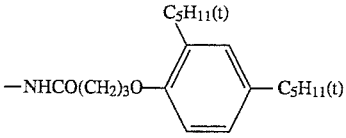

$-NHCOCHCH_2SO_2C_{12}H_{25}(n)$ (o)
$\quad\quad |$
$\quad CH_3$ $-NHCO(CH_2)_3SO_2C_{12}H_{25}(n)$ (p)

$-NHCOCH_2CHCOOH$ (q)
$\quad\quad |$
$\quad C_{18}H_{35}$ $-NHCOCH_2CH_2COOC_{12}H_{25}(n)$ (r)

$-NHSO_2C_{12}H_{25}(n)$ (s)

-continued

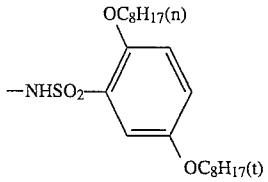

(t)

$-COOC_{14}H_{29}(n)$ (u)

$-COCHCOOC_{12}H_{25}(n)$ (v)
$\quad\quad |$
$\quad C_4H_9(n)$ $-CONHC_{14}H_{29}$ (w)

$-SO_2NHCOC_2H_5$ (x)

Examples of the two-equivalent yellow coupler represented by Formula I of the invention are listed below, but are not limited thereto.

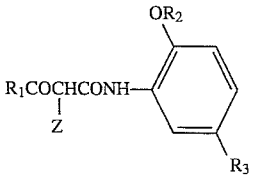

| No. | $R_1$ | $R_2$ | $R_3$ | Z |
|---|---|---|---|---|
| (1) | t-$C_4H_9$ | $CH_3$ | (d) | (A) |
| (2) | " | " | (c) | " |
| (3) | " | " | (d) | (B) |
| (4) | " | " | " | (D) |
| (5) | " | " | (f) | (E) |
| (6) | " | " | (d) | (G) |
| (7) | " | " | (k) | (H) |
| (8) | " | " | (c) | (L) |
| (9) | " | " | (g) | (H) |
| (10) | " | " | (t) | " |
| (11) | " | " | (h) | " |
| (12) | " | " | (i) | (A) |
| (13) | " | " | (j) | " |
| (14) | " | " | (l) | " |
| (15) | " | " | (i) | (N) |
| (16) | " | " | (h) | " |
| (17) | " | " | (u) | (L) |
| (18) | " | " | (e) | (M) |
| (19) | " | " | (j) | (J) |
| (20) | " | " | (m) | (A) |
| (21) | " | " | (o) | " |
| (22) | " | " | (p) | (P) |
| (23) | " | " | (d) | " |
| (24) | " | " | " | (Q) |
| (25) | " | " | (o) | " |
| (26) | " | " | (r) | (K) |
| (27) | " | " | (o) | " |
| (28) | t-$C_4H_9$ | $CH_3$ | (a) | (S) |
| (29) | " | " | (g) | (T) |
| (30) | " | " | (k) | " |
| (31) | " | " | (n) | (U) |
| (32) | " | " | (g) | (W) |
| (33) | " | " | (l) | " |
| (34) | " | " | (i) | (X) |
| (35) | " | " | (u) | (N) |
| (36) | " | " | (s) | (Y) |
| (37) | " | " | (o) | (Z) |
| (38) | " | " | (t) | (B) |
| (39) | " | " | (w) | (R) |

-continued

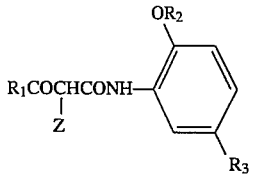

| No. | $R_1$ | $R_2$ | $R_3$ | Z |
|---|---|---|---|---|
| (40) | " | 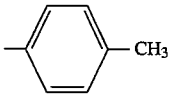 | (h) | (A) |
| (41) | " | 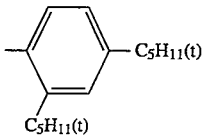 | (c) | (H) |
| (42) | " | $-CH_2COOC_{12}H_{25}(n)$ | (g) | (Z) |
| (43) | " | 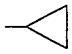 | (d) | (A) |
| (44) | 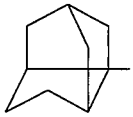 | $CH_3$ | (q) | (H) |
| (45) | t-$C_4H_9$ | $C_{16}H_{33}$ | (d) | (α) |
| (46) | " | $CH_3$ | (c) | (α) |
| (47) | " | " | (x) | (W) |

In the invention, the coating weight of the yellow coupler is preferably not more than 0.75 g/m$^2$, more preferably 0.40 to 0.71 g/m$^2$. The adding amount of the antistain agent is preferably 1 to 5 mol %, more preferably 2 to 4 mol % to the yellow coupler.

The incorporation of the antistain agent of the invention into the photographic component layer can be carried out in the manner of dissolving the antistain agent of the invention in a high-boiling organic solvent and/or a low-boiling organic solvent, emulsifiedly dispersing this solution with use of an emulsifier into a dispersion medium like an aqueous gelatin solution, and then adding this to a hydrophilic colloid layer. In this instance, the hydroquinone compound as the antistain agent of the invention and the coupler may be dispersed either together or separately.

The above high-boiling organic solvent usable for dispersing the hydroquinone compound of the invention is a compound having a dielectric constant of not more than 6.0, preferably not less than 1.9 and not more than 6.0, including esters such as phthalates and malates, organic acid amides, ketones, hydrocarbon compounds, each having a dielectric constant of not more than 6.0; particularly phthalates and malates.

The antistain agent of the invention may be used in a mixture of two or more kinds thereof in the same layer, or may be used in combination with an antistain agent other than those of HQ-I, e.g., a gallic acid derivative, 2,4-disulfonamidophenyl derivative, hydrazine derivative.

The antistain agent of the invention may be used in layers other than the lowest emulsion layer; in that case, the antistain agent for non-lowest emulsion layers and that for the lowest emulsion layer may be either the same or different.

As the magenta and cyan couplers for the color light-sensitive material of the invention there may be used any compounds capable of exerting its coupling reaction with the oxidation product of a developing agent to form coupling products having their spectral absorption maximums in longer wavelength regions than 340 nm, which are typified by compounds known as magenta couplers having their spectral absorption maximum in the wavelength region range of 500 to 600 nm and by those known as cyan couplers having their spectral absorption maximum in the wavelength region range of 600 to 750 nm.

Useful examples of the magenta coupler for the color light-sensitive material of the invention include the couplers represented by the Formulas (M-I) and (M-II) described in p.12 and Compounds MC-1 to MC-11 listed in pp.13 to 16 of JP O.P.I. No. 114154/1992.

Useful examples of the cyan coupler for the color light-sensitive material of the invention include the couplers represented by the Formulas (C-I) and (C-II) shown in p.17 and Compounds CC-1 to CC-9 listed in pp.18 to 21 of JP O.P.I. No. 114154/1992. One of these suitably usable cyan couplers is a 2-acylamino-5-ethylphenyl cyan coupler, which is typified by the compounds described in the right lower part of p.5 through the left upper part of p.6 and Couplers No. II-1 to No. II-20 listed in the light upper part of p.6 through the left upper part of p.7 of JP O.P.I. No. 251845/1990. The most suitably usable one among these compounds is Coupler II-4. Another type of suitably usable cyan couplers is a 2,5-diacylaminophenol cyan coupler, which is typified by the compounds described from the 7th line from the bottom of the left upper part to the 4th line of the right lower part of p.3 and Couplers No.I-1 to I-31 listed from the left upper part of p.4 through the left lower part of p.5 of JP O.P.I. No. 251845/1990. The most suitably usable one out of these coupounds is Compound I-2.

Where an oil-in-water-type emulsion dispersion method is used for incorporating the coupler into the light-sensitive material of the invention, the coupler is usually dissolved in a water-insoluble high-boiling organic solvent having a boiling point of not lower than 150° C., if necessary, in combination with a low-boiling and/or water-soluble organic solvent, and this solution is dispersed with a surfactant into a hydrophilic binder such as an aqueous gelatin solution by using a dispersing means such as stirrer, homogenizer, colloid mill, flow jet mixer or supersonic disperser. After or upon completion of the dispersion, a step of removing the low-boiling organic solvent is preferably inserted into the above coupler adding process.

The high-boiling organic solvent usable for the dispersion of couplers (and the hereinafter described photographically useful organic compounds such as UV absorbents, anticolorcrossover agents) is preferably a high-boiling organic solvent having a vapor pressure at 100° C. of not more than 0.5 mmHg, and more preferably a compound having a dielectric constant at 30° C. of not more than 6.0. Useful examples of the solvent are the Compounds II-1 to II-9, III-1 to III-6 listed in JP O.P.I. No. 103245/1988, the Compounds H-1 to H-22 listed in JP O.P.I. No. 196048/1989, and the Compounds II-1 to II-38 listed in JP O.P.I. No. 66646/1989. The particularly preferred among these compounds are phthalates such as dioctyl phthalate, dinonyl phthalate, di-i-dodecyl phthalate, and phosphates such as tricresyl phosphate.

As the low-boiling organic solvent, ethyl acetate may be suitably used. The surface active agent useful for the dispersion is a compound whose one molecule has a hydrophobic group having 8 to 30 carbon atoms in combination with a —$SO_3M$ or —$OSO_3M$ group (M represents a hydrogen atom or a cation). Useful examples of the surface active agent include the anionic surface active agents A-1 to A-11, more preferably A-11 and A-8, described in pp.55 and 56 of JP O.P.I. No. 26854/1989. Other surface active agents whose alkyl chain is substitued with a fluorine atom may also be suitably used.

Any of the above surface active agents is preferably added to a coating liquid. The above-mentioned dispersion liquid is usually added to a coating liquid containing the silver halide emulsion and others and coated, but is added preferably within ten hours, more preferably within 3 hours and most preferably within 20 minutes after its preparation.

For the purpose of shifting the absorption wavelength of the dye formed from any of the above couplers there may be used the Compound d-11 described in p.33 and the Compound A'-1 in p.35 of JP O.P.I. No. 114154/1992, and in addition, the fluorescent dye releasing compound described in U.S. Pat. No. 4,774,187.

The coating amount of the magenta or cyan coupler, although not restricted as long as it enables to provide a sufficiently high density, is preferably $1\times10^{-3}$ to 5 mols, and more preferably $1\times10^{-2}$ to 1 mol per tool of silver halide.

It is preferable to use the magenta coupler in combination with an antidiscoloration agent. First exemplified compounds as the antidiscoloration agent include those phenyl-ether compounds represented by the Formulas I and II described in p.3 of JP O.P.I. No. 66541/1990 and the concrete Compounds I-1 to I-32 and II-1 to II-18 listed in pp.3–5 of the same publication. The preferred among them are Compounds I-13 and II-9.

Second useful examples of the antidiscoloration agent are preferably the phenol compounds represented by the Formula IIIB described in JP O.P.I. No. 174150/1991. Among these compounds the exemplified Compounds III-1, III-12, III-13 and III-14 are more preferred, and the most preferred one out of them is the Compound III-14 listed in the same publication.

Third useful examples of the antidiscoloration agent are the amine compounds represented by the Formula A, including the exemplified Compounds A-1 to A-15 listed in JP O.P.I. No. 90445/1989, the most preferred one out of which is the Compound A-3.

The yellow coupler of the invention and the cyan coupler are preferably used in combination with an antidiscoloration agent. Useful examples of the antidiscoloration agent are preferably the compounds represented by the Formula I' described in p.8 of JP O.P.I. No. 196049/1989 and the compounds described in JP O.P.I. No. 11417/1993, and more preferably the Compounds I-10 and I-13 listed in p.9 of the same publication. The antidiscoloration agent applicable to these magenta, yellow and cyan couplers is incorporated into the same oil-in-water dispersion as the couplers in an amount of preferably 0.1 to 3 mols, more preferably 0.5 to 1.5 mol per mol of the coupler. The antidiscoloration agent is preferably used in the form of a combination of different compounds, preferred examples of which include the combination of a phenol compound represented by the Formula IIIB described in JP O.P.I. No. 17450/1991 with phenol compounds represented by the Formulas I and II described in p.3 of JP O.P.I. No. 66541/1990, and the combination of a phenol compound represented by the Formula IIIB in JP O.P.I. No. 17450/1991 with an amine compound having the Formula A described in JP O.P.I. No. 90445/1989.

The UV absorbent usable in the light-sensitive material of the invention is a compound having a spectral absorption maximum in the ultraviolet region (not longer than 400 nm) and having a molar absorptivity coefficient of not lower than 5000. Useful compounds as the UV absorbent include the Compound III-3 described in JP O.P.I. No. 250944/1989 and those compounds having the Formula I disclosed in JP O.P.I. No. 1633/1992. Concrete examples of the UV absorbent are the Compounds IIIc-1 to IIIc-17 described in JP O.P.I. No. 250944/1989, the Compounds III-1 to III-24 in JP O.P.I. No. 66646/1989, the Compounds UV-1L to UV-22L and UV-1S to UV-19S described in JP O.P.I. No. 187240/1988, and the Compounds I-1 to I-23 listed in JP O.P.I. No. 1633/1992. Among these the most preferred are the compounds IIIc-7 and IIIc-12 described in the upper left part of p.15 of JP O.P.I. No. 250944/1989 and the liquid-state UV absorbent UV-23L described in JP O.P.I. No. 187240/1988. The addition of any of these UV absorbents is preferably made according to the foregoing dispersion method, but in the invention, the high-boiling solvent applicable to the UV absorbing layer of the color light-sensitive material is added preferably in a proportion by weight of 0.3 to 0, more preferably 0.1 to 0, and most preferably 0. As the high-boiling solvent for the UV absorbent, the compounds for use in dispersion of the foregoing couplers may be preferably used. In the invention, the UV absorbent is incorporated preferably into the non-light-sensitive layer, more preferably into a non-light-sensitive intermediate layer that is located further than the furthest silver halide emulsion layer from the support and into the non-light-sensitive layer positioned between the furthest silver halide emulsion layer and the second furthest silver halide emulsion layer from the support.

In the invention, it is preferable to add fine particles powder, a matting agent, to the outermost surface layer, the furthermost from the support. The preferred as the matting agent are the compounds described from the 9th line to the 20th line in p.4 of JP O.P.I. No. 73250/1990, and the most preferred is either crystallin or noncrystalline silica, which may be used in combination of two or more different kinds thereof. The average particle size of the above matting agent is preferably 1 to 10 μm, more preferably 2 to 7 μm. The coating weight of the matting agent is preferably 0.021 to 0.1 $g/m^2$ , more preferably 0.025 to 0.08 $g/m^2$.

It is preferable to add a high-boiling organic solvent to the surface layer. The high-boiling organic solvent is preferably one having a vapor pressure at 100° C. of not more than 0.5 mmHg, and more preferably one having a dielectric constant of not more than 6.0. The exemplified compounds earlier mentioned for dispersion of the foregoing couplers, as they are, can apply as the high-boiling organic solvent in above. The adding amount of the solvent is preferably 1 to 100 $mg/m^2$, and more preferably 10 to 50 $mg/m^2$.

The light-sensitive material of the invention may contain a fluorine-containing surface active agent, organopolysiloxane, etc., added thereto for the purpose of improving its surface physical characteristics such as gloss, tacky feeling, sticking resistance, sliding property, and scratch resistance. Useful examples of the fluorine-containing surface active agent include those compounds represented by the Formulas (I), (II) and (III) described in Japanese Patent Application No. 270425/1992. The particularly preferred among these surface active agents are the Compounds FI-55, FI-81, FK-5, FK-13 and FK-23 listed in the same publication. Useful examples of the organopolysiloxane include those compounds represented by the Formulas [S1), (S2), (I), (II) and (III) described in Japanese Patent Application No. 270425. The particularly preferred among these are the Compounds S-7 and S-19 listed in the same publication.

In the invention, it is preferable to use an oil-soluble dye. The dye is an organic dye whose solubility in water at 20°

C. is not more than 0.01, and is preferably a compound of which the absorption maximum's molar absorptivity coefficient in the wavelength range of 400 nm and upward is not less than 20000. The preferred as the dye are those compounds represented by the Formulas II and III disclosed in p.26 of JP O.P.I. No. 842/1990, including the exemplified Compounds 1 to 27 listed in pp.29–32 of the same publication. The particularly preferred ones out of them are the Compounds 4 and 9. The oil-soluble dye is preferably incorporated in an amount of 0.05 to 5 mg/m$^2$ into the non-light-sensitive layer.

In the invention, it is preferable for the light-sensitive material to contain a brightening agent. The preferred as the brightening agent are those represented by the Formula II disclosed in JP O.P.I. No. 232652/1990, including the exemplified Compounds 1 to 6 listed in pp.18–20 of the same publication. The particularly preferred ones out of them are the Compounds Nos. 3, 1 and 5. Any of these brightening agents is preferably added in an amount of 0.001 to 0.3 mg/m$^2$, more preferably 0.1 to 0.2 mg/m$^2$ to the non-light-sensitive layer of the light-sensitive material of the invention.

In the invention, it is preferable to add a water-soluble polymer compound capable of complementing the above brightening agent to increase its brightening effect. Useful compounds for this purpose include polymers having reapeating units of polyvinylpyrrolidone or vinylpyrrolidone. These are preferably contained in the furthest UV absorbent-containing layer from the support and/or a layer positioned further the said layer.

In the color light-sensitive material of the invention, it is preferable to use water-soluble dyes having absorptions in various wavelength regions for the antiirradiation and antihalation purposes. Useful antiirradiation dyes include those compounds represented by the Formula II described in JP O.P.I. No. 253146/1987 and the exemplified Compounds II-1 to II-19 listed in p.12–13 of the same publication; those compounds represented by the Formula I described in JP O.P.I. No. 26850/1989 and the exemplified Compounds No.1 to No.85 listed in p.7–11 of the same publication; those compounds represented by the Formula I described in JP O.P.I. No. 97940 and the exemplified Compounds No.1 to No.103 listed from the lower part of p.5 up to the upper part of p.9 of the same publication; and the compounds disclosed from the twenty-second line of p.3 up to the second line of p.5 of Japanese Patent Application No. 182885/1992. The particularly preferred among the above compounds are the Compound No.47 having the Formula I described in JP O.P.I. No. 26850/1989, the Compound No.54 having the Formula I in JP O.P.I. No. 97940/1990, and the Compounds 1, 4, 6, 7 and 9 listed in Japanese Patent Application No. 182885/1989.

The antiirradiation dyes are used preferably in combination of ones different in the maximum absorption wavelength, such as the combination of a dye having the maximum absorption range of 600 to 700 nm, a dye having the maximum absorption range of 500 to 600 nm and a dye having the maximum absorption range of 400 to 500 nm. These dyes may be added to any layer, but is added preferably to a non-light-sensitive layer. The adding amount of each dye compound is preferably 1 to 100 mg/m$^2$, and more preferably 3 to 60 mg/m$^2$.

For the preparation of the silver halide emulsion of the invention there may be used any various methods and means known to those skilled in the art.

The silver halide emulsion of the invention may be one prepared according to any one of the acidic, neutral and ammoniacal processes. The silver halide grain may be either one directly grown at a time or one which, after making a seed grain, is prepared by growing therefrom. The method of making a seed grain may be either the same as or different from that of growing the grain.

The procedure for the reaction between a water-soluble silver salt and a water-soluble halide may be made in any one of the normal precipitation, inverse precipitation and double-jet precipitation methods or in a combination of these methods, but the double-jet precipitation is most preferred. As one form of the double-jet precipitation method, the pAg-controlled double jet precipitation method disclosed in JP O.P.I. No. 48521/1979 can also be used.

There may be used a device to supply an aqueous silver salt solution and an aqueous halide solution from an adding means arranged inside the reaction mother liquor as described in JP O.P.I. Nos. 92523/1982 and 92524/1982; a device to add an aqueous silver salt solution and an aqueous halide solution with their concentration being continuously changed as described in German OLS Patent No. 2,921,164; and a device for the process in which the reaction mother liquor is taken out of the reactor and subjected to ultrafiltration treatment for concentration, whereby the silver halide grain formation is made with the inter-grain distance being maintained constant, as described in JP E.P. No. 501776/1981.

Further, if necessary, a silver halide solvent such as thioether may be used. Additives such as mercapto group-having compounds, nitrogen-containing heterocyclic compounds and sensitizing dyes may be added during or after completion of the formation of silver halide grains.

The emulsion containing silver halide grains may have its useless water-soluble salts removed therefrom after completion of the growth of the grains or may let its useless salts remain unremoved. The removal of the salts can be carried out according to the method described in Research Disclosure 17645.

The configuration of the silver halide grain is discretional. A preferred example of the grain configuration is a cube having {100} faces as its crystal faces. Silver halide grains in the octahedral, tetradecahedral or dodecahedral crystal form, prepared according to the methods described in U.S. Pat. Nos. 4,185,756 and 4,225,666, JP O.P.I. No. 26589/1980, JP E.P. No.42737/1980, and the Journal of Photographic Science vol.21, p.39 (1973), may be used in the invention. Further, twin crystal faces-having grains may also be used.

The silver halide may be one composed of single uniform crystal grains or a mixture of grains of various crystal forms.

The grain diameter of the silver halide, although not restricted, is in the range of preferably 0.1 to 1.6 μm, and more preferably 0.2 to 1.2 μm when taking into account its adaptability to rapid processing, sensitivity and other photographic performance characteristics. The above grain can be measured according to various methods commonly employed by those in the art. The grain diameter can be found from the grain's projection image or by using its approximation.

Where the grains are substantially in the uniform configuration, the grain size distribution thereof can be considerably accurately expressed by using the diameter or projection image thereof. The silver halide grain size distribution may be either of the polydisperse or monodisperse type. The silver halide, however, is preferably a monodisperse silver halide which, in its grain size distribution, has a variation coefficient of preferably not more than 0.22 and more preferably not more than 0.15, wherein the variation coefficient is a coefficient representing the grain size distribution's broadness that is defined by:

Variation coefficient=S/R wherein S is the standard deviation of grain diameter distribution, and R is average grain diameter.

The grain diameter herein, in the case of a spherical silver halide grain, is its diameter, while in the case of a cubic or nonspherical grain, is the diamter of a circle equivalent in the area to its projection image.

The silver halide emulsion usable in the invention is silver iodobromide, silver chloroiodobromide, silver chlorobromide, silver bromide or silver chloride, but is preferably a silver chlorobromide or silver chloride emulsion which does substantially not contain silver iodide and 90 mol % or more of which is silver chloride. The 'substantially not contain silver iodide' implies that the silver iodide content of the silver halide is preferably not more than 0.5 mol %, more preferably not more than 0.1 mol %, and most preferably zero. The silver chloride content of the silver halide is preferably not less than 95 mol %, more preferably not less than 98 mol %, and most preferably not less than 99 mol %.

Where the silver halide is silver chlorobromide containing silver bromide, the grain thereof may be a core/shell-type grain consisting of inside (core) and outside (shell) phases having different silver halide compositions, or may be a grain having either thereinside or thereoutside a phase in which silver bromide is present locally, but is preferably a silver halide grain having an overall uniform composition throughout the grain.

The silver halide emulsion may have various metallic salts or metallic complex salts introduced thereinto during the course of its grain formation or physical ripening process.

Examples of the metal for such salts or complex salts include those belonging to Groups VIB, VIIB, VIII, IIB, IIIA and IVA of the periodic table, and the most useful among the above are those salts or complex salts of Mn, Fe, Co. Ni, Zn, Ga, Ge, Mo, Ru, Pd, Cd, In, Sn, W, Re, Os, Ir, Pt, Tl and Au. These may be used alone or in combination.

Useful examples of the metallic salt or metallic complex salt are described in Japanese Patent Application No. 251468/1992 and JP O.P.I. Nos. 51232/1992, 131838/1992, 336537/1992, 281638/1993, 125629/1992, 251469/1992 and 253081/1992.

The adding quantity of the above compound used, although dependent largely upon its kind or the purpose for which it is used, is preferably $10^{-11}$ to $10^{-3}$ mol per mol of silver halide.

The silver halide emulsion may be sensitized with a combined use of a gold sensitization method that uses a gold compound and a (sulfur) sensitization method that uses a chalcogen sensitizer.

As the gold sensitizer there may be used chloroauric acid, gold chloride, gold thiosulfate or various other gold complex salts. As the oxidation compound there are dimethylrhodanine, thiocyanic acid, mercaptotetrazole, mercaptotriazole, and the like.

The using amount of the gold sensitizer, although different according to the kind of the silver halide emulsion used, the kind of the gold compound used, ripening conditions, etc., is usually preferably $1\times10^{-9}$ to $1\times10^{-4}$ mol, more preferably $1\times10^{-8}$ to $1\times10^{-5}$ mol per mol of silver halide.

As the chalcogen sensitizer there may be used a sulfur sensitizer, a selenium sensitizer and a tellurium sensitizer, but the preferred one of these is the sulfur sensitizer. Examples of the sulfur sensitizer include thiosulfates, allylthiocarbamide, thiourea, allylisothiocyanate, cystine, p-toluene sulfonate, rhodanine and elemental sulfur.

The light-sensitive material may be subjected to reduction sensitization treatment. There are known methods for the reduction sensitization; e.g., a method for adding various reducing agents, a method in which the emulsion ripening is made under a high silver ion concentration and a method in which the emulsion ripening is carried out under a high pH condition.

Examples of the reducing agent for use in reduction sensitization include stannous salts such as stannous chloride, boranes such as tri-t-butylamineborane, sulfites such as sodium sulfite and potassium sulfite, reductones such as ascorbic acid, and thiourea dioxide. Of these compounds the preferred are the thiourea dioxide, ascorbic acid and its derivatives, and sulfites. The use of the above reducing agents for reduction sensitization is excellent in the reproducibility as compared with the reduction sensitization by the use of silver ion concentration control or pH control in the ripening process.

The above reducing agent is dissolved in a solvent such as water or an alcohol and the solution is added to the silver halide emulsion for its ripening treatment, or added to the emulsion at the time of its silver halide grain formation to make reduction sensitization simultaneously with the grain formation.

The adding quantity of the reducing agent, although its adjustment is necessary according to pH or silver ion concentration of the silver halide emulsion, is usually preferably $10^{-7}$ to $10^{-2}$ mol per mol of silver halide.

After the reduction sensitization treatment, a small quantity of an oxidation agent may be used in order to modify the reduction sensitizing nucleus or to deactivate the residual reducing agent. Examples of the compound used for this purpose include potassium hexacyanoferrate, bromosuccineimide, p-quinone, potassium perchlorate, thiosulfinic acid and hydrogen peroxide.

The silver halide emulsion may have a silver halide solvent added thereto during its sensitization process. Useful examples of the silver halide solvent include thiocyanate compounds such as potassium thiocyanate, sodium thiocyanate, calcium thiocyanate, magnesium thiocyanate, silver thiocyanate and ammonium thiocyanate.

The pH and pAg at the time of the sensitization are not limited; normally pH is 4.0 to 11.0, while pAg is 4.5 to 8.5.

In the silver halide emulsion, there may be used known antifoggant/stabilizer compounds for the purpose of preventing the emulsion from fogging in the course of preparing a light-sensitive material, of minimizing the change in the performance characteristics of the light-sensitive material during its storage, or of inhibiting the light-sensitive material from fogging during its development. Examples of the compound usable for the above purposes include those represented by the following Formula S:

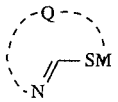

Formula S wherein Q represents a group of nonmetallic atoms necessary to form a 5- or 6-member nitrogen-containing heterocyclic ring; M represents a hydrogen atom or an alkali metallic atom.

Examples of the 5-member heterocyclic ring represented by Q include an imidazole ring, tetrazole ring, thiazole ring, oxazole ring, selenazole ring, benzimidazole ring, naphthoimidazole ring, benzothiazole ring, naphthothiazole ring, benzoselenazole ring, naphthoselenazole ring and benzoxazole ring. Examples of the 6-member heterocyclic ring represented by Q include a pyridine ring, pyrimidine ring and quinoline ring. These 5- and 6-member heterocyclic rings include those each having a substituent. The alkali metallic atom represented by M is a sodium atom or a potassium atom.

More preferred structures of the mercapto compound represented by Formula S are as described in the paragraphs Nos. 0016 to 0032 of Japanese Patent Application No. 330655/1994, and the exemplified compounds of Formula S are listed as S-1-1 to S-4-8 in the paragraphs Nos.0034 to 0039 of the same publication. In addition, the compounds represented by the Formula I described in JP O.P.I. No. 2816381993 are also useful and the exemplified compounds therefor are listed in the paragraphs 0026 to 0028 of the same publication.

As the spectral sensitizing dyes for the silver halide emulsion to be used in the light-sensitive material of the invention there may be used known compounds. As the blue-sensitizing dye the Compounds BS-1 to BS-8 disclosed in p.108–109 of Japanese Patent Application No. 51124/1990 may be suitably used alone or in combination. As the green-sensitizing dye the Compounds GS-1 to GS-5 listed in p.110 of the same publication may be suitably used.

Where the light-sensitive material of the invention is exposed by a semiconductor laser printer, it is necessary to use an infrared-sensitizing dye. As the infrared-sensitizing dye the dye Compounds IRS-1 to IRS-11 described in p.12–14 of JP O.P.I. No. 285950/1992 may be preferably used. In addition, it is preferable to use these sensitizing dyes in combination with the supersensitizers SS-1 to SS-9 described in p.14–15 of the same publication.

Where the light-sensitive material of the invention is exposed with use of a laser light, it is advantageous to use a semiconductor layer-provided exposure means for downsizing the printer. In the scanning exposure, the exposure time per pixel corresponds to the moment for which the silver halide emulsion is actually exposed. The exposure time per pixel, in the case of the scanning exposure by a laser light, is defined by:

(Diameter of luminous flux)/(scanning speed)

wherein the diameter of luminous flux is the distance between the two points at which the line passing the largest intensity point of light goes in parallel with the laser scanning direction intersects the peripheral edges of a luminous flux, said peripheral edges of the luminus flux being determined to be at the contour line where the light intensity is reduced by half of its maximum intensity value.

Examples of the laser printer considered applicable to the above system include those described in JP O.P.I. Nos. 4071/1980, 11062/1984, 197947/1988, 74942/1990 and 236538/1990, JP E.P. Nos. 14965/1981 and 40822/1981, and European Patent No. 77410.

As the red-sensitizing dye there may be suitably used those cyanine dyes represented by the following Formulas [2] and [3]:

Formula [2]

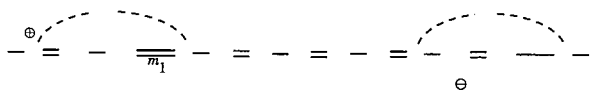

Formula [3]

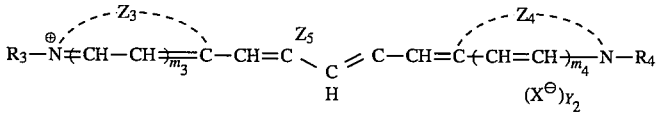

wherein $R_1$, $R_2$, $R_3$ and $R_4$ each represent an alkyl group, an alkenyl group or an aryl group; $L_1$, $L_2$, $L_3$, $L_4$ and $L_5$ each represent a methine group; $Z_1$, $Z_2$, $Z_3$ and $Z_4$ each represent an atom or a group of atoms necessary to complete a 5- or 6-member heterocyclic ring; $Z_5$ represents a group of atoms necessary to form a 6-member carbon ring; $m_1$, $m_2$, $m_3$ and $m_4$ each represent an integer of 0 or 1; n represents an integer of 0 or 1; $X^-$ is an acid anion; $Y_1$ and $Y_2$ each represent an integer of 0 or 1, provided when the compound forms an intramolecular salt, $Y_1$ and $Y_2$ each are zero.

Useful compounds as the supersensitizer for the silver halide emulsion are stilbene, azaindene, mercaptoheterocyclic compound, thiourea or phenol-hexamethylene condensates, and more preferably 9- or above-member cyclic or heterocyclic compounds.

The above cyclic compound is preferably one having aliphatic rings and/or aromatic rings with ether linkage, more preferably having four or less aliphatic rings for forming a cyclic compound, and most preferably a large cyclic compound having aromatic rings.

Typical examples of the above compound are crown ethers, and particular examples thereof include the Compounds S-1 to S-39 listed in the paragraphs 0049 to 0055 of Japanese Patent Application No. 330655/1992.

In the light-sensitive material of the invention, gelatin is advantageously used as its binder for dispersion and preparation of coating liquids.

Gelatin is produced according to any of the methods described in T. H. James, The Theory of The Photographic Process, 4th ed. (1977) p.55, and the Shashin Kogaku No Kiso/Gin'en Shashin Hen (Basic Course of Photographic Technology/Silver Halide Photography) p.119–124. As the raw material for producing gelatin, cowbones (osein), cowhide and pigskin are used. Of these the preferred is the gelatin produced from cow-bones. Gelatin may also be a mixture of two or more kinds of them.

Gelatin is prepared by an alkali, acid or oxygen process, and the preferred is alkali-processed gelatin. The isoelectric point of the alkali-processed gelatin is preferably not less than 4.5, and more preferably not less than 5. Gelatin can be normally subjected to ion-exchange treatment, such as cation-, anion- or amphoteric ion-exchange treatment. Of these treated gelatins, although discretionarily selectable according to uses, the gelatin subjected to amphoteric ion-exchange treatment is preferred. Hydrogen peroxide-treated gelatin may be suitably used as well.

The hydrogen peroxide treatment may be conducted in any step of the production process of gelatin; for example, may be conducted directly to osein gelatin, conducted in the midst of or after the alkali treatment, or after the process of extracting a gelatin solution. In the invention, the preferred is the gelatin prepared by adding hydrogen peroxide thereto during its alkali treatment. The adding amount of hydrogen peroxide is 1 to 100 g in pure $H_2O_2$ per kg of osein gelatin. The reaction with hydrogen peroxide takes place preferably at pH of not less than 9.0.

As for gelatin composition, it is preferred for gelatin to comprise a small low-molecular component with a large high-molecular component. Measurement of the high- and low-molecular components can be carried out according to the method described from the 15th line in the lower left part of p.2 to the 8th line in the upper left part of p.3 of JP O.P.I. No. 265247/1995. When indicated according to this method, gelatin having a high-molecular component content of not less than 30% and/or a low-molecular component content of not more than 40% is preferred. The molecular weight of gelatin is preferably 10,000 to 200,000.

The jelly strength of gelatin should be as high as possible, preferably not less than 250, and more preferably not less than 270.

The ion content, an impurity, of gelatin should be as low as possible; e.g., calcium ion is preferably not more than 5000 ppm, more preferably not more than 2000 ppm. However, there are cases where calcium should rather be present in an amount of 4000 to 5000 ppm depending on the kind of the emulsion used.

The allowable amount of heavy metal ions, such as iron and copper ions, contained in gelatin is preferably not more than 500 ppm in total, and that of each heavy metal not more than 10 ppm, particularly not more than 5 ppm in the case of iron ions.

The specific rotation of gelatin should be as high as possible, preferably not lower than 150, and preferably not lower than 210 when used in the topmost layer of the light-sensitive material.

The less the tint of gelatin, the better. An aqueous 10% by weight gelatin solution that is advantageous for the invention preferably has a transmittance at 420 nm of not less than 50%, more preferably not less than 60%, and most preferably not less than 70%. To raise the transmittance of gelatin, arbitrary selection of the raw material therefor, hydrogen peroxide treatment, ion exchange, adsorption by chelating resins and the like are necessary.

The total amount of gelatin to be contained in the light-sensitive material of the invention is not more than 10.0 $g/m^2$, preferably not more than 7.0 $g/m^2$ and, although no lower limit is set thereto, generally preferably not less than 3.0 $g/m^2$ from the physical or photographic characteristics poing of view. The amount of gelatin can be found by calculating in terms of the weight of gelatin containing 11.0% water in the moisture measuring method described in the PAGI method (PAGI stands for Photographic and Gelatin Industries, Japan).

In the light-sensitive material of the invention, a hardener may be used for the binder. Useful examples of the hardener include vinylsulfone-type hardeners and chlorotriazine-type hardeners. As the vinylsulfone-type hardener there may be suitably used any one of the compounds described from the 13th line in the upper right part of p.25 to the second line in the upper right part of p.27 of JP O.P.I. No. 249054/1986. The most preferred one out of the above compounds is the Compound H-12 indicated in p26 of the same publication. As the chlorotriazine hardener there may be suitably used any one of the compounds described from the first line in the lower left part of p.3 to the 4th line from the bottom in the lower right part of p.3 and from the 4th line from the bottom in the lower right part of p.3 to the lower right part of p.5 of JP O.P.I. No. 245153/1986. The most preferred one out of these chlorotriazine hardeners is the Compound XII-1 described in p.4 of the same publication. Any of these hardeners is preferably used in combination with different other compound, and may be added to any layers of the light-sensitive material. The above hardener is preferably used in an amount of 0.1 to 10% by weight to the binder.

In the light-sensitive material of the invention, it is preferable to add an atimold agent to some layer of the light-sensitive material. Useful examples of the antimold agent include those compounds represented by the Formula II described in p.9 of JP O.P.I. No. 157646/1991 and the exemplified Compounds No.9 to No.22 listed in p.69–70 of the same publication. The most preferred one of them is Compound No.9. Such chloro triazine hardeners are defined as follows:

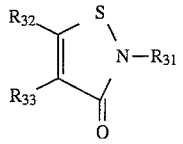

(XXI)

wherein $R_{31}$ is hydrogen, alkyl, cycloalkyl, alkenyl, aralkyl, aryl, alkoxy, —COHNR, in which R is alkyl, aryl, alkylthio, arylthio, alkylsulfonyl or arlysulfonyl, or heterocyclic; $R_{32}$ and $R_{33}$ each independently represented hydrogen, halogen, alkyl, cycloalkyl, aryl, a heterocyclic, cyano, alkylthio, arylthio, alkylthiosulfoxide, alkylsulfonyl, alkylsulfinyl; $R_{32}$ and $R_{33}$ may combine to form a benzene ring which may have a substituent. In formula XXI, the number of carbon atoms in the alkyl or the alkenyl represented by $R_{31}$ is preferably 1 to 36, more preferably, 1 to 18. The number of carbon atoms in the cycloalkyl is preferably 3 to 12, more preferably 3 to 6. These alkyl, alkenyl, cycloalkyl, aryl and heterocyclic may each have a substituent selected from halogen, nitro, cyano, thiocyano, aryl, alkoxy, aryloxy, carboxyl, sulfoxy, alkylcarbonyl, alkoxycarbonyl, aryloxycarbonyl, sulfo, acyloxy, sulfamoyl, carbamoyl, acylamino, diacylamino, ureido, thioureido, urethane, thiourethane, sulfonamide, a heterocyclic, arylsulfonyloxy, alkylsulfonyloxy, arylsulfonyl, alkylsulfonyl, arylsulfinyl, alkylamino, dialkylamino, anilino, N-alkylanilino, N-arylanilino, N-acylamino, hydroxyl and mercapto.

The number of carbon atoms in the alkyl represented by $R_{30}$ and $R_{40}$ is preferably 1 to 18, more preferably 1 to 9. The number of carbon atoms in the cycloalkyl is preferably 3 to 16, more preferably 3 to 6. These alkyl, cycloalkyl, and heterocyclic groups may have a substituent, such as halogen, nitro, sulfo, aryl, and hydroxyl. When $R_{32}$ and $R_{33}$ form a benzene ring, a group capable of being a substituent of the benzene ring can be present, including hydrogen, halogen, alkyl, alkoxyl, cyano and nitro.

In the light-sensitive material of the invention, a preservative and an antimold agent may be used, useful examples of which include the compounds described from the 16th line in the lower right part of p.17 to the lower left part of p.19 of JP O.P.I. No. 157646/1991.

The reflective support for the light-sensitive material of the invention may be a support made of any appropriate material, such as a white pigment-containing polyethylene-coated paper, baryta paper, vinyl chloride sheets, white pigment-containing polypropylene, polyethylene terephthalate or the like. The most preferred is a support having on its surface a white pigment-containing polyolefin resin layer.

Useful white pigments for the reflective support are inorganic and organic white pigments, and preferably inorganic white pigments, including alkaline earth metal sulfates such as barium sulfate; alkaline earth metal carbonates such as calcium carbonate; silicas such as powdery silicic acid or synthetic silicate, calcium silicate; alumina, alumina hydrate, titanium oxide, zinc oxide, talc, and clay, but the preferred are barium sulfate and titanium oxide. The white pigment may be subjected to surface treatment with aluminum hydroxide, an alcohol or a surface active agent.

The white pigment content of the water-resistant resin layer surface of the reflective support is preferably not less than 10% by weight, more preferably not less than 13% by weight and most preferably not less than 15% by weight of the layer. The dispersion degree of the white pigment in the water-resistant resin layer of the paper support can be measured and determined according to the method described in JP O.P.I. No. 28640/1990. When measured according to this method, the dispersion degree of the white pigment is preferably not more than 0.20, more preferably not more than 0.15 and most preferably not less than 0.10 as the variation coefficient described in the above publication. The surface of the paper support is preferably as much smooth as possible, and its central average roughness (SRa) is preferably not more than 1.0 μm. The calculation of SRa can be made according to the equation described in p.6 of JP O.P.I. No. 165163/1993.

The raw material for producing the support of the invention is selected from among prevalent materials, such as bleached softwood kraft pulp (NBKP), bleached hardwood kraft pulp (LBKP), bleached softwood sulfite pulp (NBSP), bleached hardwood sulfite pulp (LBSP), etc., which may be used alone or in combination of two or more kinds thereof. The preferred combining proportion of broadleaf pulp/conifer pulp is preferably 95/5 to 60/40.

In the invention, the raw paper material for the support has its property, such as water resistance, strengthened preferably by adding thereto various additives as given below: For example, sizing agents such as alkylketenedimer fatty acid salts, rosin, maleated rosin, alkenyl succinate, alkyl succinate and polysaccharides may be suitably used. The preferred one of them is the alkylketenedimer fatty acid salt, which is used preferably in an amount of 0.2 to 2% of the pulp. Dry paper strength increasing agents such as cationized starch, cationized polyacrylamide, anionized polyacrylamide and carboxy-denatured polyvinyl alcohol may be used, the preferred ones out of which are the cationized starch and anionized polyacrylamide. Wet paper strength increasing agents such as melamine resin, urea resin and epoxidated polyamide resin may be used. the preferred one of these resins is the epoxidated polyamide resin. In general, the pulp surface is subjected to tubsize or sizepress treatment with a liquid containing water-soluble polymer additives. Examples of the water-soluble polymer additive include cationized starch, polyvinyl alcohol, carboxy-denatured polyvinyl alcohol, carboxymethyl cellulose, hydroxymethyl cellulose, hydroxyethyl cellulose, polyacrylamide and gelatin. The preferred among these additives are the cationized starch and polyvinyl alcohol.

As the antifoggant to be added to the paper, there may be used the water-soluble iodide compounds described in JP O.P.I. No. 103549/1980; the weak acid salts or oxides of magnesium, calcium or zinc described in JP O.P.I. No. 43637/1981; the urea compounds having a molecular weight of not more than 150 described in JP O.P.I. No. 97343/1981; and the magnesium compounds described JP O.P.I. No. 19405/1993. The preferred among these compounds are magnesium hydroxide, magnesium oxide, calcium oxide and zinc oxide, and these each may be used in an amount of 0.1 to 10% by weight of the pulp. And further various other additives are used in combination, including inorganic electrolytes such as sodium chloride, Glauber's salt, etc., of which the preferred is sodium chloride; hygroscopic substances such as glycerol, polyethylene glycol, etc.; pH adjusting agents such as hydrochloric acid, sodium hydroxide, sodium carbonate, etc.; dyes such as blue dyes, particularly ultramarine blue; brightening agents, antistatic agents and defoaming agents. The pulp, after being moderately ground into pieces, has the above additives at need added thereto to become pulp slurry for use in make paper with use of a large oblong paper making device. The obtained paper is then dried and subjected to supercalender treatment. Prior to or after this drying process, the paper is subjected to surface sizing treatment.

The support is preferably one prepared by having both sides of the above obtained paper coated with polyolefin resin. Examples of the polyolefin resin include, for example, single polymers of α-olefins such as polyethylene, polypropylene, etc., and a mixture of these polymers. The particularly preferred polyolefin is a high-density polyolefin, a low-density olefin or a mixture thereof. The molecular weight of such olefins, although not restricted, is in the range of normally 20,000 to 200,000. The thickness of the polyolefin resin coat layer is not restricted either, but is normally in the range of about 15 to 50 μm. Where the support is a paper support, it may take many different forms; for example, a single-weight paper having a support thickness of 80 to 180 μm, and peelable/adhesive-type paper and double-weight paper as described in Japanese Utility Model No. 29550/1989 may also be used. Where the support is one made of polypropylene or polyethylene terephthalate, the support can be of the transparent, translucent or opaque type by adjusting the amount of the white pigment to be coated thereon. The support preferably has an oxygen transmittance of not more than 2.0 $cc/m^2.hr.atm$.

As the reflective support for the light-sensitive material of the invention, a paper support for photographic paper having at least one side thereof an electron beam-set resin coat layer containing inorganic and/or organic white pigment is suitably usable because it is excellent in the surface smoothness and it enables high-sharpness image formation.

The electron beam setting coating liquid comprises at least one organic compound capable of producing an electron beam-setting resin, pigments, preferably inorganic pigments, and if necessary other additives.

The organic compound polymerizable to be set by electron beam irradiation includes unsaturated compounds containing 2 or more carbon-carbon double bonds in one molecule thereof such as acryl and methacryl oligomers, and unsaturated compounds containing at least one carbon-carbon double bond in one molecule thereof such as monofunctional acryl monomers, methacryl monomers and vinyl monomers.

The above unsaturated organic compound, when subjected to electron beam irradiation, generates free radicals for polymerization to cause its inter- and intra-molecular bridging reactions, resulting in the cross linkage formation to thereby become hard to produce a hardened resin.

A typical example of the above resin is a compound with its framework composed of polyester, polyurethane, polyether or polycarbonate, having acryloyl and methacryloyl groups on both terminals of the framework.

Examples of the acryl and methacryl oligomers include polyurethane acrylate and methacrylate, polyether acrylate and methacrylate, bisphenol A acrylate and methacrylate, and polyester maleate and fumarate. Examples of the polyfunctional acryl monomer and methacryl monomer include 1,6-hexanediol-diacrylate, neopentyl diacrylate, diethylene glycol diacrylate, diethylene glycol dimethacrylate, tetraethylene glycol diacrylate, glycerol trimethacrylate, polyethylene glycol dimethacrylate, trimethylol propane triacrylate, pentaerythritol triacrylate, pentaerythritol pentacrylate, neopentyl glycol diacrylate, isocyanuric acid diacrylate, isocyanuric acid triacrylate, trimethylolpropane triacrylate, and propylene oxide-denatured trimethylolpropane polyacrylate. Examples of the polyfunctional acryl monomer, methacryl monomer and vinyl monomer include methyl acrylate, ethyl acrylate, butoxyethyl acrylate, benzyl acrylate, glycidyl methacrylate, 2-hydroxyethyl acrylate, 2-hydroxyethyl methacrylate, phenoxyethyl acrylate, N,N-diethylaminoethyl methacrylate, styrene, N-vinylpyrrolidone, polyoxyethylenephenol acrylate and 2-ethylhexyl acrylate.

Those commercially available include Aronix M-5700 and M-6100 (polyester acrylates), Aronix M-1100 and M-1200 (urethane acrylates), Aronix M-101 and M-102 (monofunctional acrylates), and Aronix M-210 and M-215 (polyfunctional acrylates), all above produced by Toa Gosei Co., and GE-510 (epoxy compound), produced by Mitsubishi Gas Co.

The coating liquid contains an electron beam setting organic compound dissolved or dispersed in an organic solvent and pigments, usually white inorganic pigments, uniformly mixed therewith, in which the white pigments may be the same as those used for the foregoing reflective support.

The white pigment content of the coating liquid is preferably set so as to be 20 to 80% by weight of the whole solid matter weight in the hardened resin coat layer. If the content is lower than 20% by weight, the resulting image on the paper becomes inferior in the sharpness, while if exceeding 80% by weight, the elasticity of the obtained hardened resin coat layer is reduced, causing the layer to be cracked. Dispersing the white pigment into the electron beam setting unsaturated organic compound can be carried out by using, for example, a three-roll mill, a homomixer, a sandgrinder or a supersonic disperser.

As the above organic solvent there may be used, for example, acetone, methyl-ethyl ketone, ethyl acetate, butyl acetate, ether, glycol-monoethyl ether, dioxane, benzene, toluene, xylene, ethylene chloride, carbon tetrachloride, chloroform or dichlorobenzene.

For coating, a roller coating method may be used. Alternatively, any of prevalent methods for sheet coating, including bar coating, air-doctor coating, blade coating, squeeze coating, air-knife coating, reverse roll coating and transfer coating methods, may also be used. In addition, a fountain coater or slit-orifice coater process can also be used.

No particular restrictions are placed on the electron beam irradiation equipment used. In general, as an electron beam accelerator for the electron beam irradiation, a unit of the curtain beam type making a high power output available at a relatively low cost can be effectively used. The acceleration voltage at the time of the electron beam irradiation is preferably 100 to 300 kv, and the absorption dose is preferably 0.5 to 10 Mrad.

The coated layer is preferably 3 to 100 μm in thickness, and more preferably 5 to 50 μm in thickness.

The layer surface, after its hardening, may be at need subjected to surface smoothening treatment with use of a mirror surface roller or to surface matting treatment with use of a silk finish roller or mat roller. On the support, after being at need subjected to surface corona discharge treatment, UV irradiation treatment and flame treatment, the light-sensitive material of the invention may be formed by coating necessary layers directly or indirectly through a subbing layer or subbing layers (for improving the characteristics thereof such as surface adhesion, antistatic property, dimensional stability, wear resistance, hardness, antihalation characteristic, frictional characteristic and/or other characteristics).

At the time of coating silver halide emulsions for preparing the light-sensitive material of the invention a thickener may be used for the purpose of improving the coatability. For the coating, the extrusion coating or curtain coating method that enables the coating of two or more layers at the same time is useful.

The above prepared light-sensitive material for printing use is imagewise exposed through a processed negative image film. The negative film used may be any of various types. Various negative films having various spectral sensitivities may be used. The negative film is preferably KONICA Color Super DD100, more preferably KONICA Impressa50 and Fuji Reara. Exposure time ranges from scores of milliseconds to scores of seconds. For the exposure of the light-sensitive material, any method normally prevailing in ordinary photofinishers may be used. Suitably usable printers include KONICA Printers CRP-5N2, SCP-8015 and KCP-7N3, Gretag 3141 printer, Agfa MSP printer and Kodak CLAS35 printer. The use of an enlarger for making large-format prints also is suitably prevailing.

In the invention, the duration between the exposure and the development of the light-sensitive material is required to be as much short as possible in order to shorten the overall processing time. The light-sensitive material of the invention makes it possible to stably provide a high-quality image with little or no change in the image density even in the case of an exposure-development duration of not longer than 30 seconds.

As the aromatic primary amine developing agent used in the invention, known compounds may be used; the following are typical examples of the compound.

CD-1: N,N-diethyl-p-phenylenediamine,

CD-2: 2-Amino-5-diethylaminotoluene,

CD-3: 2-Amino-5-(N-ethyl-N-laurylamino)toluene,

CD-4: 4-(N-ethyl-N-β-hydroxyethylamino)aniline,

CD-5: 2-Methyl-4-(N-ethyl-N-β-hydroxyethylamino)aniline,

CD-6: 4-Amino-3-methyl-N-ethyl-N-(β-methanesulfonamidoethyl)aniline,

CD-7: N-(2-amino-5-diethylaminophenylethyl) methanesulfonamide,

CD-8: N,N-dimethyl-p-phenylenediamine,

CD-9: 4-Amino-3-methyl-N-ethyl-N-methoxyethylaniline,

CD-10: 4-Amino-3-methyl-N-ethyl-N-(β-ethoxyethyl)aniline,

CD-11: 4-Amino-3-methyl-N-ethyl-N-(β-butoxyethyl)aniline,

CD-12: 4-(N-ethyl-N-(β-hydroxypropylamino)aniline.

The above color developing agents may be used alone or in combination with known p-phenylenediamine derivatives.

The color developing agent is used in an amount of usually $1\times10^{-2}$ to $2\times10^{-1}$ mol per liter of a developer solution, and in the amount range of preferably $1.5\times10^{-2}$ to $2\times10^{-1}$ mol per liter of a color developer solution from the view point of rapid processing.

The preferred as the color developing agent for use in processing the light-sensitive material of the invention are CD-5, CD-6 and CD-9.

These p-phenylenediamine derivatives are used generally in the form of their sulfate, hydrochloride, sulfite, nitrate or p-toluenesulfonate.

The preferred developer solution for processing the light-sensitive material of the invention does substantially not contain benzyl alcohol, wherein the 'substantially not contain' means that the benzyl alcohol content is not more than 2 cc/liter. It is most preferred in the invention that the developer solution contains no benzyl alcohol at all.

The developer solution, in addition to the above agent, may also contain the following constituents: alkali agents such as sodium hydroxide, potassium hydroxide, sodium metaborate, potassium metaborate, sodium tertiary phosphate, potassium tertiary phosphate, borax and silicate, which may be used alone or in combination within limits not to produce precipitates or to be able to retain pH stabilization effect. Further, for the necessity in preparation or for the purpose of raising the ion strength, various salts such as disodium hydrogenphosphate, dipotassium hydrogenphosphate, sodium hydrogencarbonate, potassium hydrogencarbonate, and borates may be used.

It is preferable for the color developer solution used for processing the light-sensitive material to contain chlorine ions in a concentration of $2.5\times10^{-2}$ to $5\times10^{-1}$ mol/liter and bromine ions in a concentration of $2.0\times10^{-5}$ to $2.0\times10^{-2}$ mol/liter.

The chlorine and bromine ions may be added directly to the developer solution or may be eluted from the light-sensitive material into the developer solution. When added directly to the color developer solution, examples of the chlorine ion donor include sodium chloride, potassium chloride, ammonium chloride, lithium chloride, nickel chloride, magnesium chloride, manganese chloride, calcium chloride and cadmium chloride. Of these chlorides the preferred are sodium chloride and potassium chloride. Such chlorides may be supplied from the brightening agent contained in the developer solution.

Examples of the bromine ion donor include sodium bromide, potassium bromide, ammonium bromide, lithium bromide, nickel bromide, magnesium bromide, manganese bromide, calcium bromide, cadmium bromide, cerium bromide and thalium bromide. Of these bromides the preferred are sodium bromide and potassium bromide. In the case of having such chlorine or bromine ions eluted from the light-sensitive material into the developer solution during its developing process, they may be supplied either from the emulsion layer or from the nonemulsion layer of the light-sensitive material.

In the color developer solution for use in the invention, in place of the hydroxylamine used as the conventional preservative there may be used any of those hydroxylamine derivatives as described in JP O.P.I. Nos. 146043/1988, 146042/1988, 146041/1988, 146040/1988, 135938/1988, 118748/1988 and 179351/1988 and those organic preservatives such as hydroxamic acids, hydrazines, phenols, α-hydroxyketons, α-aminoketones, sugars, monoamines, diamines, quaternary ammonium salts, nitroxyradicals, alcohols, oximes, diamide compounds and condensed cyclic amines.

These compounds may be used in combination with the conventional hydroxylamine and the above-mentioned organic preservatives, but it is better not to use the conventional hydroxylamine from the standpoint of developing characteristics.

Further, if necessary, a development accelerator may be used. Useful examples of the development accelerator include those various pyridinium compounds, other cationic compounds, cationic dyes such as phenosafranine, and neutral salts such as thalium nitrate as described in U.S. Pat. Nos. 2,648,604 and 3,671,247, and JP E.P. No. 9503/1969; those polyethylene glycols and their derivatives and nonionic compounds such as polythioethers as described in U.S. Pat. Nos. 2,533,990, 2,531,832, 2,950,970 and 2,577,127, and JP E.P. No. 9504/1969; those organic solvents as described in JP E.P. No. 9509/1969; and organic amines, ethanolamine, ethylenediamine, diethanolamine, triethanolamine, and the like; and those phenethyl alcohol, acetylene glycol, methyl-ethyl ketone, cyclohexanone, pyridine, ammonia, hydrazine, thioethers, amines, and the like as described in U.S. Pat. No. 2,304,925.

If necessary, ethylene glycol, methyl cellosolve, methanol, acetone, dimethylformamide, β-cyclodextrine, p-toluenesulfonic acid, and those compounds as described in JP E.P. Nos. 33378/1972 and 9509/1969 may be used as dissolution assistants for raising the solubility of the developing agent.

Further, an auxiliary developing agent may be used in combination with the developing agent. Examples of the auxiliary developing agent include N-methyl-p-aminophenol sulfate, phenidone, N,N-diethyl-p-aminophenol hydrochloride, and N,N,N',N'-tetramethyl-p-phenylenediamine hydrochloride. The adding amount of the agent is normally 0.01 to 1.0 g per liter of the developer solution. In addition, if necessary, a competing coupler, a fogging agent, a development inhibitor releasing coupler (DIR coupler), a development inhibitor releasing compound and the like may also be added.

Besides, other additives usable include antistain agents, antisludge agents, intereffect accelerators and the like.

The above respective constituents of the color developer solution are added in sequence to and dissolved with stirring in a specified amount of water. In this instance, those constituents less soluble in water can be added in the form of a mixture with an organic solvent such as triethanolamine as mentioned above. In a more popularized form, a prepackaged concentrated aqueous solution of or solid powdery form of such respective constituents capable of stably coexisting may be put into and dissolved with stirring in water, whereby a color developer solution can be prepared.

The sulfite concentration in the color developer solution is preferably not more than $1\times10^{-2}$ mol/liter, more preferably zero to $7\times10^{-3}$ mol/liter and most preferably zero to $5\times10^{-3}$ mol/liter.

In the invention, the color developer solution can be used at any pH value, but is preferably at pH9.5 to 13.0 and more preferably at pH 9.8 to 12.0 from the viewpoint of rapid processing.

Color developing temperature is preferably 25° to 70° C. The higher the temperature, the shorter can the developing time be, but the temperature should not be too high from the standpoint of the solution's stability and is preferably 25° to 50° C. The color developing time is preferably 70 to 240 seconds. If shorter than 70 seconds, the maximum density may become unstable during a run of continuous processing, while if longer than 240 seconds, sludge tends to deposit in the developer solution, so that the time is more preferably 90 to 220 seconds.

The replenishing amount to the color developer solution is preferably not more than 200 ml/liter, more preferably 20 to 180 ml/liter, and most preferably 20 to 165 ml/liter.

The course of processing the light-sensitive material comprises substantially a color developing process, a bleach-fix process and a washing process (including a washing-substitute stabilizing process), but is allowed to have an additional process or to be replaced by other equivalent process. For example, the bleach-fix process can be divided into a bleaching process and a fixing process. Placing an additional bleaching process before the bleach-fix process is possible. Providing a bleach-fix process immediately after the color developing process is suited to the course of processing the color light-sensitive material of the invention.

The bleaching agent used in the bleach-fix solution, although not limited, is preferably an organic metallic complex salt. The complex salt is one in which an organic acid such as polycarboxylic acid, aminopolycarboxylic acid, oxalic aid or citric acid is coordinated to a metallic ion such as iron ion, cobalt ion or copper ion. The most useful organic acid for use in the formation of a metallic complex salt thereof is a polycarboxylic acid or aminopolycarboxylic acid. These polycarboxylic acid and aminopolycarboxylic acid may be in the form of alkali metallic salts, ammonium salts or water-soluble amine salts. Concrete examples of such compounds are found as the Compounds 2 to 20 listed in p.58–59 of JP O.P.I. No. 205262/1989.

The bleaching agent is used in an amount of 5 to 450 g, more preferably 20 to 250 g per liter of the bleach-fix solution.

The bleach-fix solution contains a silver halide fixing agent besides the above bleaching agent, and, if necessary, also contains a sulfite as the preservative thereof. There may also be used a bleach-fix solution containing ferric ethylenediaminetetraacetate as a bleaching agent, a silver halide fixing agent and a large amount of a halide such as ammonium bromide, and a special bleach-fix solution comprising in combination ferric ethylenediaminetetraacetate as a bleaching agent and a large amount of ammonium bromide.

As the above halide there may also be used hydrochloric acid, hydrobromic acid, lithium bromide, sodium bromide, potassium bromide, sodium iodide, potassium iodide and ammonium iodide in addition to the above ammonium bromide.

The aforementioned silver halide fixing agent contained in the bleach-fix solution is a compound capable of reacting with silver halide to form a water-soluble complex salt as employed in ordinary fixing solution, which includes thiosulfates such as, e.g., potassium thiosulfate, sodium thiosulfate and ammonium thiosulfate; thiocyanates such as potassium thiocyanate, sodium thiocyanate and ammonium thiocyanate; thiourea, thioether.

The fixing agent is preferably used in an amount of not less than 5 g per liter of the fixing solution; used in any dissolvable amount range, but is normally 70 to 250 g per liter of the solution.

In the bleach-fix solution, various pH buffers may be used which include boric acid, borax, sodium hydroxide, potassium hydroxide, sodium carbonate, potassium carbonate, potassium hydrogencarbonate, acetic acid, sodium acetate and ammonium hydroxide, which may be used alone or in combination. Further, various brightening agents, defoaming agents or surface active agents may also be incorporated. Preservatives such as hydroxylamine, hydrazine and sulfite adducts of aldehyde compounds, organic chelating agents such as aminopolycarboxylic acid, stabilizers such as nitroalcohol, nitrate, etc., and organic solvents such as methanol, dimethylformamide, dimethylsulfoxide, and the like, may be arbitrarily incorporated.

The bleach-fix solution may contain any of those various bleaching acelerating agents as described in JP O.P.I. No. 280/1971, JP E.P. Nos. 8506/1970 and 556/1971, Belgian Patent No. 770,910, JP E.P. Nos. 8836/1970 and 9854/1978, JP O.P.I. Nos. 71634/1979 and 42349/1974.

The bleach-fix solution is used at pH of not more than 4.0, normally at pH of 4.0 to 9.5, preferably at pH of 4.5 to 8.5, and most preferably at pH of 5.0 to 8.5. The processing temperature in the solution is not higher than 80° C., preferably not higher than 55° C. The processing time in the solution is preferably not longer than 240 seconds.

In the processing of the invention, after the color developing, the bleach-fix process is followed by the washing process. Then, the preferred embodiment of the washing process is described below:

Useful compounds for the washing solution include chelating agents whose chelating stability constant to iron ions is not less than 8, wherein the chelating stability constant implies the constant generally known by L. G. Sillen & A. E. Martell, 'Stability Constants of Metalion Complexes' The Chemical Society, London (1964), and Chaberek & A. E. Martell, 'Organic Sequestering Agents,' Wiley (1959).

The chelating agent, whose chelating stability constant to iron ions is 8, includes organic carboxylic acid chelating agent, organic phosphoric acid chelating agent, inorganic phosphoric acid chelating agent, and polyhydroxy compounds. The above iron ions imply ferric ions. Concrete examples of the chelating agent whose chelating stability constant to ferric ions is not less than 8 are the compounds described from the 15th line in p.63 to the 17th line in p.64 of JP O.P.I. No. 205162/1989.

The using amount of the above chelating agent is preferably 0.01 to 50 g, more preferably 0.05 to 20 g per liter of the washing solution.

The particularly preferred as an additive to the washing solution are ammonium compounds, which are provided by ammonium salts of various inorganic compounds; the exemplified compounds thereof are described from the 5th line in p.65 to the 11th line in p.66 of JP O.P.I. No. 205162/1989.

The adding amount of the ammonium compound is preferably not less than $1.0\times10^{-5}$ mol, more preferably 0.001 to 5.0 mol and most preferably 0.002 to 1.0 mol per liter of the washing solution.

The washing solution preferably contains a sulfite to an extent not to allow the generation or growth of bacteria. The sulfite to be incorporated into the washing solution may be any organic or inorganic one as long as it can release sulfite ions, but is preferably an organic sulfite, examples of which include sodium sulfite, potassium sulfite, ammonium sulfite, ammonium hydrogen sulfite, potassium hydrogensulfite, sodium hydrogensulfite, sodium metabisulfite, potassium metabisulfite, ammonium metabisulfite, hydrosulfite, sodium glutaraldehydebishydrogensulfite and sodium succinatealdehydebishydrogensulfite.

The sulfite is added in an amount of preferably at least $1.0\times10^{-5}$ mol, and more preferably $5\times10^{-5}$ to $1.0\times10^{-1}$ mol per liter of the washing solution. The sulfite may be added directly to the washing solution, but is more preferably added to a replenisher to the solution.

The washing solution used in the invention preferably contains an antimold agent, whereby the improvement on the antisulfurization and storage stability of printed/processed images can be achieved. Examples of the antimold agent include sorbic acid, benzoate compounds, phenol compounds, thiazole compounds, pyridine compounds, guanidine compounds, morpholine compounds, quaternary phosphonium compounds, ammonium compounds, urea compounds, isooxazole compounds, propanolamine compounds, sulfamide compounds, pyronone compounds and amino compounds; concrete compounds thereof are found as the exemplified compounds listed from the 10th line in p.68 to the 16th line in p.72 of JP O.P.I. No. 205162/1989. The preferred among these compounds are the thiazole compounds, sulfamide compounds and pyronone compounds.

To the washing solution the antimold agent is added in the amount range of preferably 0.001 to 30 g, more preferably 0.003 to 5 g per liter of the washing solution.

The washing solution of the invention, in combination with the chelating agent, preferably contains a metallic compound; examples of the metal for such compounds include Ba, Ca, Ce, Co, In, La, Mn, Ni, Bi, Pb, Sn, Ti, Zr, Mg, Al and Sr. These metallic compounds can be provided in the form of either inorganic or organic salts such as halides, sulfates, carbonates, phosphates and acetates or of hydroxides or water-soluble chelate compounds.

The above metallic compound is added in the amount range of preferably $1.0\times10^{-4}$ to $1.0\times10^{-1}$ mol, and more preferably $4.0\times10^{-4}$ to $2.0\times10^{-2}$ mol per mol of the washing solution.

What the washing solution may contain in addition to the above compound include an aldehyde group-containing compound, examples of which include the exemplified Compounds 1 to 32 listed in p.73–75 of JP O.P.I. No. 205162/1989.

The above aldehyde group-containing compound is used in the amount range of preferably 0.1 to 50 g, and more preferably 0.5 to 10 g per liter of the washing solution.

As the wash water used in the invention an ion-exchange water subjected to treatment with an ion-exchange resin may be used.

The pH range of the wash water applicable to the invention is 5.5 to 10.0; the pH adjusting agent applicable thereto may be any one of those generally known as alkali and acid agents.

Washing temperature is preferably 15° to 60° C., and more preferably 20° to 45° C. Washing time is preferably not longer than 240 seconds. Where the washing takes place in plural baths, the washing time preferably gets shorter toward the fore bath and gets longer toward the rear bath; particularly, it is preferred that the washing in each bath be made in sequence for a duration 20 to 50% longer than in the preceding one.

Supply of wash water to the washing process, in the case of a multibath counterflow current system, is preferably made to the rearmost bath from which wash water is overflowed to the preceding bath. Of course washing can be made in a single bath. For the addition of the above compound, there are various ways; for example, the compound is added in the form of a concentrated solution to the wash water bath, or added in combination with other additives to wash water to be supplied to the wash water bath for preparation of a wash water replenisher.

The quantity of wash water necessary for the washing process in the invention is preferably 0.1 to 50 times, more preferably 0.5 to 30 times the carry-in amount per unit area of the light-sensitive material from the preceding bath (usually bleach-fix or fixing solution).

The washing bath in the washing process consists preferably of 1 to 5 sub-baths, and more preferably of 1 to 3 sub-baths.

As the processing apparatus for the light-sensitive material of the invention any known processor may be used, which may be either of the roller transport type in which the light-sensitive material is nipped and transported by the rollers arranged inside its processing baths or of the endless belt transport type in which the light-sensitive material is fixed to and transported by its endless belt. Further, other types of applicable apparatus to the invention include one having processing baths in the slit form through which the light-sensitive material is transported along with a processing solution being supplied thereto, one being of the type of spraying processing solutions, one designed so as to bring the light-sensitive material into contact with a processing solution-impregnated carrier, and one being of the type of processing the light-sensitive material in viscous processing solutions.

In the invention, in the case where a run of processing large quantities of light-sensitive materials is conducted in the above color developing to drying processes, and during the course the elution of some constituents from the light-sensitive materials being processed into the processing solutions, interbath contamination, evaporation and saturation of the processing solutions have occurred, the effect of the invention clearly appears particularly when another light sensitive material is processed again after making these phenomena steady.

These exposure to drying processes are provided in, e.g., a large-scale automatic color processor to be installed in a professional photofinisher. The preferred examples of such the processor include, for example, NORITSU PRV2-406, PRV2-212 and PRV2-416. The above processing capacity can also be covered by minilab systems, suitable examples of which include, e.g., KONICA NICE PRINT SYSTEM NPS-602QA, NORITSU QSS-1404, and FUJI FA-120.

The processing may also be made in KONICA NICE PRINT SYSTEM Friendy SQA-Z, which enables the waste liquid recycling with ACR-40, suitable for protection of environment.

EXAMPLES

The invention is illustrated in detail by the following examples, but the invention is not limited thereto.

Example 1

Twenty percent sulfite-bleached conifer pulp (NBSP) beaten to an extent of having a canadian standard freeness (JIS P-8121-76) of 250 ml and 80% sulfite-bleached broadleaf pulp (LBSP) beaten to an extent of having the above freeness of 280 ml were mixed to thereby prepare a pulp slurry having a concentration of 1%.

To the above slurry were added cationic starch, alkylketenedimer resin, anionic polyacrylamide resin and polyamidopolyamine-epichlorohydrin, and after completion of the sufficient dispersion thereof, magnesium hydroxide was added so that its final content of the paper after being produced comes to 5% by weight of the whole solid amount.

The produced from the above slurry was a paper as substrate having a weight of 170 g/m$^2$.

A polyethylene resin layer was coated on each of both the silver halide light-sensitive layer-coating-side surface (obverse) and the surface on the opposite side thereto (reverse) of the paper support. Firstly, a high-density polyethylene and a low-density polyethylene were molten together at 300° C., and this molten polyethylene resin composition was extruded through a slit to make its extrusion coating to form a polyethylene backing layer of 30 μm in thickness on the reverse of the paper support. Subsequently, a mixture of a high-density polyethylene, a low-density polyethylene and an anatase-type titanium oxide white pigment (pigment content: 13% by weight of the polyethylene composition) was kneaded/fused at 300° C. to prepare a polyethylene resin composition, and this composition was extruded through a slit for coating to form a 30 μm-thick white resin layer on the obverse of the paper support, whereby a white resin layer-having water-resistant photographic support was obtained.

The light-sensitive layer-coating side (the white resin layer side) of the photographic support obtained above, after being subjected to corona discharge treatment, was coated thereon with a gelatin subbing layer so as to have a gelatin coating weight of 40 mg/m$^2$, and then dried, and then the support was provided for coating the following light-sensitive layers and other layers.

On this reflective support were coated the layers having the compositions described in Tables 1 and 2, whereby a multi-layer color light-sensitive material was produced. The coating liquids used were prepared as follows:

Layer 1 coating liquid

Twenty-six point seven grams of yellow coupler Y-1, 10.0 g of dye image stabilizer ST-1, 6.67 g of similar stabilizer ST-2, 0.78 g of antistain agent HQ-4 and 6.67 g of high-boiling organic solvent DNP were dissolved by adding 60 cc of ethyl acetate thereto, and this solution was emulsified/dispersed by using a supersonic homogenizer into 220 cc of an aqueous 10% gelatin solution containing 7 cc of a 20% surface active agent SU-1, whereby a yellow coupler disperseion was prepared. The dispersion was mixed with a blue-sensitive silver halide emulsion prepared under the following conditions to thereby prepare a Layer 1 coating liquid.

Coating liquids for Layers 2 to 7 were prepared in the same manner as in the above coating liquid for Layer 1.

A hardener H-1 was added to Layers 2 and 4, and another hardener H-2 to Layer 7. Surfactants SU-2 and SU-3 were added as coating aids for adjusting the surface tension of each liquid.

| Layer | Composition | Added amt (g/m$^2$) |
|---|---|---|
| Layer 7 (Protective layer) | Gelatin | 1.00 |
| | Antistain agent HQ-7 | 0.002 |
| | Antistain agent HQ-8 | 0.002 |
| | Antistain agent HQ-9 | 0.004 |
| | Antistain agent HQ-19 | 0.02 |
| | Compounds B, C, D, E | each $2 \times 10^{-5}$ |
| | DIDP | 0.005 |
| | Silicon dioxide | 0.003 |
| | Antimold agent F-1 | 0.002 |
| Layer 6 (UV absorbing layer) | Gelatin | 0.40 |
| | AI-2 | 0.02 |
| | AI-4 | 0.01 |
| | UV absorbent UV-1 | 0.10 |
| | UV absorbent UV-2 | 0.40 |
| | UV absorbent UV-3 | 0.16 |
| | UV absorbent UV-19 | 0.04 |
| | Compound E | $4 \times 10^{-4}$ |
| | DNP | 0.20 |
| | Compounds F, G | each $2 \times 10^{-4}$ |
| | PVP | 0.03 |
| Layer 6 | Gelatin | 1.30 |

-continued

| Layer | Composition | Added amt (g/m$^2$) |
|---|---|---|
| (Red-sensitive layer | Red-sensitive silver chlorobromide emulsion Em-R | 0.21 |
| | Cyan coupler C-1 | 0.10 |
| | Cyan coupler C-2 | 0.28 |
| | Image stabilizer ST-1 | 0.20 |
| | Antistain agent HQ-4 | 0.01 |
| | HBS-1 | 0.20 |
| | DOP | 0.20 |
| Layer 4 (UV absorbing layer) | Gelatin | 0.94 |
| | UV absorbent UV-1 | 0.28 |
| | UV absorbent UV-2 | 0.09 |
| | UV absorbent UV-3 | 0.38 |
| | Compounds F, G | each $4 \times 10^{-4}$ |
| | Antistain agent | 0.10 |
| | Compound E | $1 \times 10^{-3}$ |
| | DNP | 0.50 |
| Layer 3 (Green-sensitive layer) | Gelatin | 1.40 |
| | AI-1 | 0.01 |
| | Green-sensitive silver chlorobromide emulsion Em-G | 0.17 |
| | Magenta coupler M-1 | 0.23 |
| | Dye image stabilizer ST-3 | 0.20 |
| | Dye image stabilizer ST-4 | 0.17 |
| | DIDP | 0.13 |
| | DBP | 0.13 |
| Layer 2 (Interlayer) | Compounds F, G | 1.20 |
| | AI-3 | 0.01 |
| | Antistain agent HQ-7 | 0.03 |
| | Antistain agent HQ-8 | 0.03 |
| | Antistain agent HQ-9 | 0.05 |
| | Antistain agent HQ-19 | 0.23 |
| | Compounds C, D, E | each $3 \times 10^{-4}$ |
| | DIDP | 0.06 |
| | Brightening agent W-1 | 0.10 |
| | Antimold agent F-1 | 0.02 |
| Layer 1 (Blue-sensitive layer) | Gelatin | 1.20 |
| | Blue-sensitive silver chlorobromide emulsion Em-B | 0.26 |
| | Yellow coupler Y-1 | 0.80 |
| | Dye image stabilizer ST-1 | 0.30 |
| | Dye image stabilizer ST-2 | 0.20 |
| | Antistain agent HQ-4 | 0.02 |
| | Compound A | $2 \times 10^{-4}$ |
| | DNP | 0.20 |
| Support | Polyethylene-laminated paper (containing a slight amount of a tinting agent) | |

In the above table, the added amount of the silver halide emulsion is in silver equivalent.

SU-1: Sodium tri-i-propylnaphthalenesulfonate

SU-2: Sodium di-(2-ethylhexyl)sulfosuccinate

SU-3: Sodium di-(2,2,3,3,4,4,5,5-octafluoropentyl)sulfosuccinate

DBP: Dibutyl phthalate

DNP: Dinonyl phthalate

DOP: Dioctyl phthalate

DIDP: Di-i-decyl phthalate

PVP: Polyvinyl pyrrolidone

H-1 : Tetrakis(vinylsulfonylmethyl)methane

H-2 : Sodium 2,4-dichloro-6-hydroxy-s-triazine (Exemplified Yellow Coupler 25 of the present invention)

Y-1

-continued
M-1
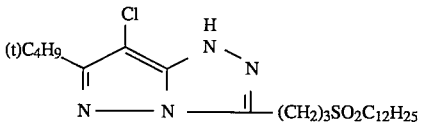
C-1
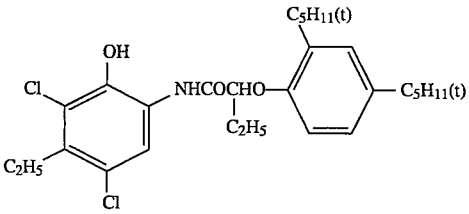
(Compound II-4 listed in JP O.P.I. No. 251845/1990)
C-2
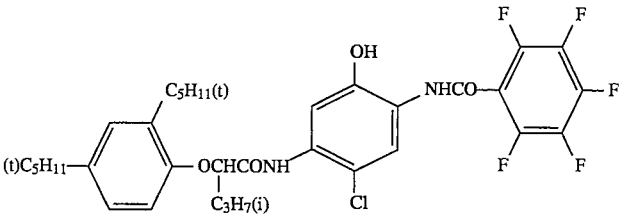
(Compound I-2 listed in JP O.P.I. No. 251845/1990)
ST-1
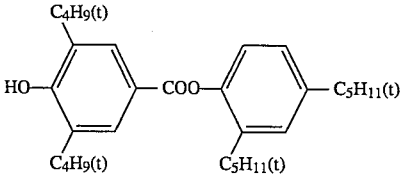
(Compound I-13 listed in JP O.P.I. No. 196049/1989)
ST-2
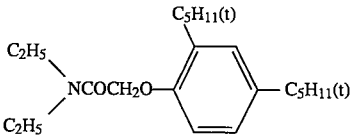
ST-3
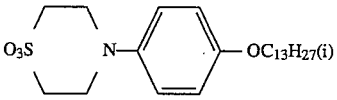
(Compound A-3 listed in JP O.P.I. No. 90445/1989)
ST-4
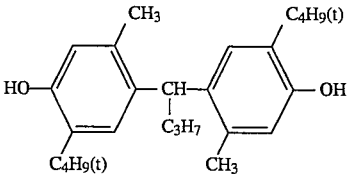
(Compound III-14 listed in JP O.P.I. No. 174150/1991)
Compounds A, B, C, D, E (corresponding to quinone compounds of HQ-4, 7, 8, 9, respectively)
Compound F
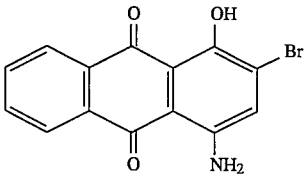
(Compound 4 listed in JP O.P.I. No. 842/1990)

-continued
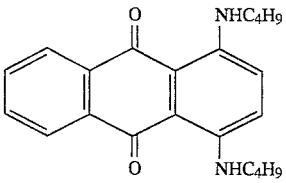
(Compound 9 listed in JP O.P.I. No. 842/1990)Compound G
HBS-1
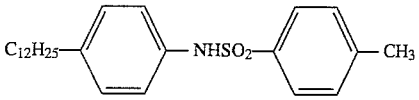
UV-1
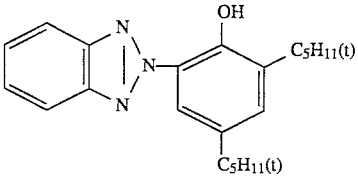
(Compound IIIc-1 listed in JP O.P.I. No. 2590944/1989)
UV-2
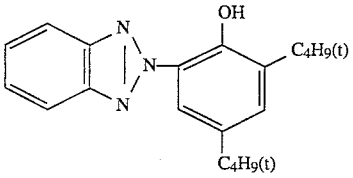
(Compound IIIc-7 listed in JP O.P.I. No. 2590944/1989)
UV-3
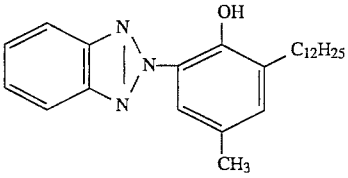
(Compound UV-23L listed in JP O.P.I. No. 187240/1988)
AI-1
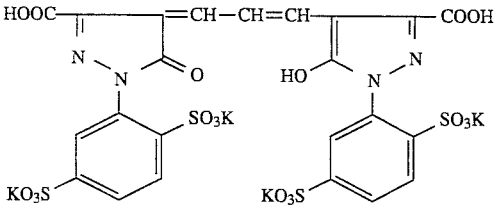
AI-2
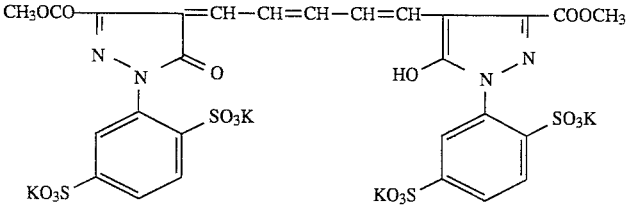
AI-3
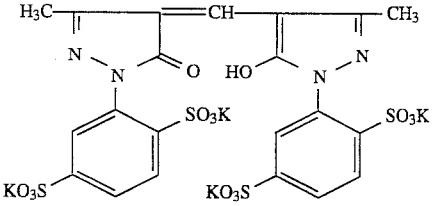

-continued

AI-4

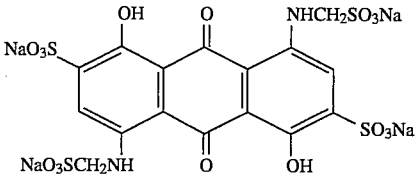

W-1

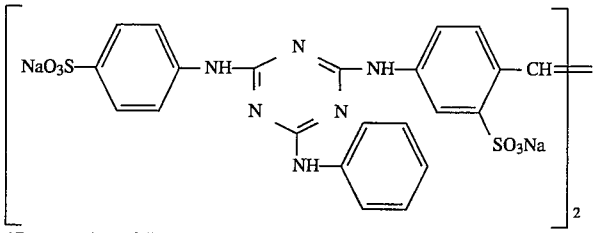

(Compound No. 3 listed in JP O.P.I. No. 232652/1990)

F-1

A mixture of

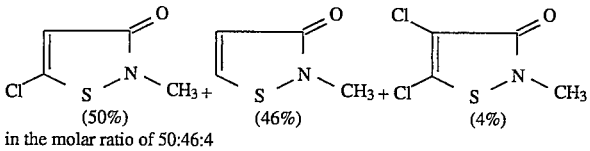

in the molar ratio of 50:46:4

(Compound No. 9 listed in JP O.P.I. No. 157646/1991)

Preparation of blue-sensitive silver halide emulsion

To one liter of an aqueous 2% gelatin solution kept at 40° C. were simultaneously added, spending 30 minutes, the following Solutions A and B with pAg and pH being controlled to 7.3 and 3.0, respectively, and further simultaneously added, spending 180 minutes, the following Solutions C and D with pAg and pH being controlled to 8.0 and 5.5, respectively. In this instance, the pAg control was made according to the method described in JP O.P.I.No.45437/1984, while the pH control was conducted with use of an aqueous sodium hydroxide solution.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| $K_2IrCl_6$ | $2 \times 10^{-8}$ mol/mol Ag |
| Sodium chloride | 102.7 g |
| $K_4Fe(CN)_6$ | $1 \times 10^{-5}$ mol/mol Ag |
| Potassium bromide | 1.0 g |
| Water to make | 600 ml |
| Solution D | |
| Silver nitrate | 300 g |
| Water to make | 600 ml |

After completion of the addition, an aqueous 5% solution of Demol N, produced by Kao Atlas Co., and an aqueous 20% magnesium sulfate solution were used to make desalting, the above emulsion was mixed with an aqueous gelatin solution, whereby a monodisperse cubic grains emulsion EMP-1 having an average grain diameter of 0.85 μm, grain diameter distribution's variation coefficient of 0.07, and silver chloride content of 99.5 mol % was obtained.

Emulsion EMP-1 was subjected to optimal chemical sensitization at 60° C. by using the following compounds, whereby a comparative blue-sensitive silver halide emulsion Em-B was obtained.

| | |
|---|---|
| Sodium thiosulfate | 0.8 mg/mol AgX |
| Chloroauric acid | 0.5 mg/mol AgX |
| Stabilizer STAB-3 | $8 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver halide emulsion

A monodisperse cubic grains emulsion EMP-2 having an average grain diameter of 0.43 μm, variation coefficient of 0.08 and a silver chloride content of 99.5% was prepared in the same manner as in EMP-1 except that the adding duration of Solutions A and B and that of Solutions C and D were changed.

EMP-2 was subjected to optimal chemical sensitization at 55° C. by using the following compounds, whereby a green-sensitive silver halide emulsion Em-G was obtained.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Stabilizer STAB-2 | $3 \times 10^{-4}$ mol/mol AgX |
| Sensitizing dye GS-1 | $4 \times 10^{-4}$ mol/mol AgX |

Preparation of red-sensitive silver halide emulsion

A monodisperse cubic grains emulsion EMP-3 having an average grain diameter of 0.50 μm, variation coefficient of 0.08 and a silver chloride content of 99.5% was prepared in the same manner as in EMP-1 except that the adding duration of Solutions A and B and that of Solutions C and D were changed.

EMP-3 was subjected to optimal chemical sensitiation at 60° C. by using the following compounds, whereby a red-sensitive silver halide emulsion Em-R was obtained.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Stabilizer STAB-2 | $3 \times 10^{-4}$ mol/mol AgX |
| Sensitizing dye RS-1 | $1 \times 10^{-4}$ mol/mol AgX |
| Supersensitizer RSS-1 | $3 \times 10^{-3}$ mol/mol AgX |

The thus obtained sample was designated to Sample 101 (comparative).

STAB-1: 1-(3-acetamidophenyl)-5-mercaptotetrazole

STAB-2: 1-Phenyl-5-mercaptotetrazole

STAB-3: 1-(4-ethoxyphenyl)-5-mercaptotetrazaole

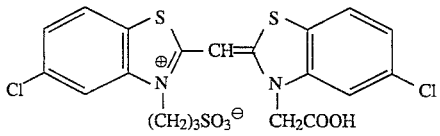

BS-1

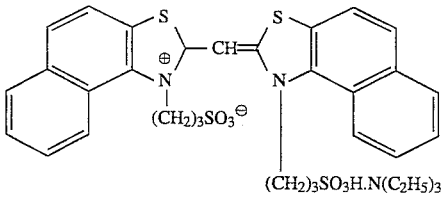

BS-2

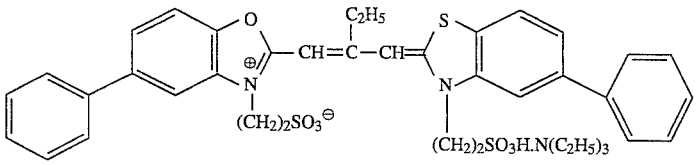

GS-1

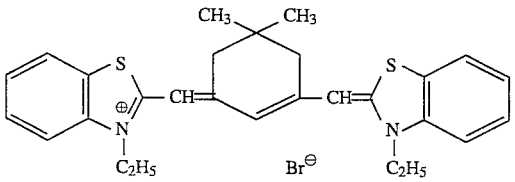

RS-1

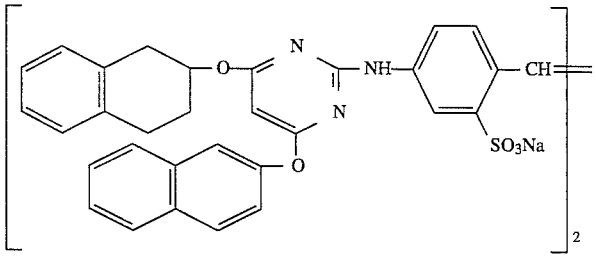

RSS-1

Samples 102 to 108 were prepared in the same manner as in Sample 101 except that the quantity of the antistain agent in Layer 1 and Layer 5 was changed as shown in Table 3. Further, Samples 109 to 113 were prepared likewise except that the Layer 1 and Layer 5 were replaced with each other.

Each sample was exposed through an optical wedge to a white light in the usual manner, and then processed according to the following procedure steps:

| Processing step | Temperature | Time | Replenishing quantity |
|---|---|---|---|
| Color developing | 38.0 ± 0.3° C. | 45 seconds | 80 ml |
| Bleach-fix | 35.0 ± 0.5° C. | 45 seconds | 120 ml |
| Stabilizing | 30 to 34° C. | 60 seconds | 150 ml |
| Drying | 60 to 80° C. | 30 seconds | |

The compositions of the processing solutions used are as follows:

| | Tank Sol. | Replenisher |
|---|---|---|
| Color developer tank solution and replenisher thereto | | |
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriaminepentaacetate | 2.0 g | 2.0 g |
| Brightening agent, 4,4'-diaminostilbene-disulfonic acid derivative | 2.0 g | 2.5 g |
| Potassium carbonate | 30 g | 30 g |
| Water to make | 1 liter | 1 liter |
| Adjust pH to | 10.10 | 10.60 |
| Bleach-fix tank solution and replenisher thereto | | |
| Ferric ammonium diethylenetriaminepenta-acetate, dehydrate | 65 g | |
| Diethylenetriaminepentaacetic acid | 3 g | |
| Ammonium thiosulfate (70% solution) | 100 ml | |
| 2-Amino-5-mercapto-1,3,4-thiadiazole | 2.0 g | |
| Ammonium sulfite (40% solution) | 27.5 ml | |
| Water to make 1 liter. | | |
| Adjust pH to 6.5 with potassium carbonate or glacial acetic acid. | | |
| Stabilizing tank solution and replenisher thereto | | |
| o-Phenylphenol | 1.0 g | |
| 5-chloro-2-methyl-4-isothiazolin-3-one | 0.02 g | |
| 2-Methyl-4-isothiazolin-3-one | 0.02 g | |
| Diethylene glycol | 1.0 g | |
| Brightening agent (Chinopal SFP) | 2.0 g | |
| 1-hydroxyethylidene-l,l-diphosphonic acid | 1.8 g | |
| Bismuth chloride (45% solution) | 0.65 g | |
| Magnesium sulfate, heptahydrate | 0.2 g | |
| PVP | 1.0 g | |
| Ammonia water (25% ammonium hydroxide sol.) | 2.5 g | |
| Trisodium nitrilotriacetate | 1.5 g | |
| Water to make 1 liter | | |

Each of the processed samples was measured with respect to its color fog, maximum color density and resistance to light. The results are shown in Table 3.

Color fog

The minimum reflection densities $D^B$min and $D^R$min of each sample were measured with a PDA-65 densitometer, manufactured by KONICA Corp.

Resistance to light

Each sample was set to an outdoor exposure stand covered with a glass plate and exposed to sunlight for 50 days, and after that, the blue-light and red-light reflection densities of it before and after the exposure to sunlight were measured with the PDA-65 densitometer. The fading degree (%) of each sample due to the exposure was found according to the following equation:

$$\text{Fading degree (\%)}=(D_0-D/D_0)\times 100$$

wherein $D_0$=density before exposure to sunlight (1.0)

D=density after exposure to sunlight

TABLE 3

| | Antistain agent/coupler(molar ratio) | | Color fog | | Max. color density | | Fading (%) | |
|---|---|---|---|---|---|---|---|---|
| Sample No. | Yellow | Cyan | $D^B$min | $D^R$min | $D^B$max | $D^R$max | B | R |
| 101 (Comp.) | 0.07(Layer 1) | 0.07(Layer 5) | 0.015 | 0.010 | 2.30 | 2.63 | 20 | 25 |
| 102 (Inv.) | 0.05(Layer 1) | 0.05(Layer 5) | 0.016 | 0.021 | 2.35 | 2.66 | 16 | 20 |
| 103 (Inv.) | 0.03(Layer 1) | 0.03(Layer 5) | 0.016 | 0.023 | 2.37 | 2.69 | 15 | 20 |
| 104 (Inv.) | 0.01(Layer 1) | 0.01(Layer 5) | 0.018 | 0.026 | 2.39 | 2.72 | 15 | 19 |

TABLE 3-continued

| Sample No. | Antistain agent/ coupler(molar ratio) Yellow | Cyan | Color fog $D^Bmin$ | $D^Rmin$ | Max. color density $D^Bmax$ | $D^Rmax$ | Fading (%) B | R |
|---|---|---|---|---|---|---|---|---|
| 105 (Inv.) | 0.05(Layer 1) | 0.07(Layer 5) | 0.016 | 0.010 | 2.35 | 2.63 | 16 | 25 |
| 106 (Inv.) | 0.03(Layer 1) | 0.07(Layer 5) | 0.016 | 0.010 | 2.38 | 2.62 | 15 | 25 |
| 107 (Inv.) | 0.01(Layer 1) | 0.07(Layer 5) | 0.018 | 0.010 | 2.39 | 2.63 | 15 | 26 |
| 108 (Comp.) | 0 (Layer 1) | 0 (Layer 5) | 0.030 | 0.028 | 2.41 | 2.76 | 14 | 18 |
| 109 (Comp.) | 0.07(Layer 5) | 0.07(Layer 1) | 0.015 | 0.010 | 2.50 | 2.53 | 22 | 22 |
| 110 (Inv.) | 0.05(Layer 5) | 0.05(Layer 1) | 0.022 | 0.015 | 2.52 | 2.60 | 18 | 17 |
| 111 (Inv.) | 0.03(Layer 5) | 0.03(Layer 1) | 0.025 | 0.018 | 2.54 | 2.61 | 17 | 16 |
| 112 (Inv.) | 0.01(Layer 5) | 0.01(Layer 1) | 0.028 | 0.022 | 2.57 | 2.61 | 16 | 16 |
| 113 (Comp.) | 0 (Layer 5) | 0 (Layer 1) | 0.030 | 0.029 | 2.63 | 2.63 | 16 | 15 |

By comparison between the $D^Bmin$ values of Samples 101 to 108 and the $D^Rmin$ values of Samples 109 to 113, it is understood that in the silver halide emulsion layer closest to the support, even when the amount of the antistain agent is reduced to be within the range for the invention, it can sufficiently inhibt the emulsion layer from forming color fog. On the other hand, it is understood from the comparison between the $D^Rmin$ values of Samples 101 to 105 and the $D^Bmin$ values of Samples 106 to 110 that in Layer 5 that is positioned far from the support, when the amount of the antistain agent is reduced to be within the range for the invention, it becomes unable to sufficiently inhibit the color fog. In addition, the use of the antistain agent in a reduced amount within the range for the invention enables to increase the maximum color densities as well as to improve the resistance to light.

It is understood that the effect of the invention is significantly great particularly when the coupler of Layer 1 is a yellow coupler.

Example 2

Samples 201 to 232 were prepared in the same manner as in Sample 101 of Example 1 except that the yellow coupler, the antistain agent/yellow coupler ratio, and the dye image stabilizer in the Layer 1 of the light-sensitive material in Example 1 were changed as shown in Table 2.

Each sample was exposed through an optical wedge to a blue light as usual, processed in like manner, and then the yellow color-formed sample was subjected to color fog and the maximum color density measurements, light resistance test, and color reproducibility evaluation.

The results are shown in Table 4.

Color reproducibility

The color reproducibility of the yellow image was subjected to the following two-step evaluation.

A: Good

B: Orangy-yellow colored

TABLE 4

| Sample No. | Yellow coupler | Antistain* agent/yellow coupler | Dye image stabilizer | Color fog | Fading (%) | Maximum color density | color reproducibility |
|---|---|---|---|---|---|---|---|
| 201 (Comp.) | Y-2 | 0.07 | ST-1, ST-2 | 0.017 | 20 | 2.28 | B |
| 202 (Inv.) | Y-2 | 0.05 | ST-1, ST-2 | 0.021 | 15 | 2.35 | B |
| 203 (Comp.) | Y-2 | 0 | ST-1, ST-2 | 0.037 | 15 | 2.40 | B |
| 204 (Comp.) | (1) | 0.07 | ST-1, ST-2 | 0.015 | 19 | 2.30 | A |
| 205 (Inv.) | (1) | 0.05 | ST-1, ST-2 | 0.019 | 14 | 2.39 | A |
| 206 (Comp.) | (1) | 0.07 | ST-5, ST-7 | 0.014 | 18 | 2.30 | A |
| 207 (Inv.) | (1) | 0.05 | ST-5, ST-7 | 0.014 | 12 | 2.34 | A |
| 208 (Inv.) | (1) | 0.02 | ST-5, ST-7 | 0.015 | 9 | 2.38 | A |
| 209 (Inv. | (1) | 0.01 | ST-5, ST-7 | 0.015 | 9 | 2.49 | A |
| 210 (Inv.) | (1) | 0.05 | ST-5, ST-7 | 0.018 | 8 | 2.41 | A |
| 211 (Inv.) | (1) | 0.05 | ST-5, ST-6 | 0.016 | 9 | 2.42 | A |
| 212 (Inv.) | (2) | 0.05 | ST-5, ST-7 | 0.017 | 10 | 2.30 | A |
| 213 (Inv.) | (3) | 0.05 | ST-5, ST-7 | 0.017 | 11 | 2.39 | A |
| 214 (Inv.) | (7) | 0.05 | ST-5, ST-7 | 0.019 | 10 | 2.38 | A |
| 215 (Inv.) | (8) | 0.05 | ST-5, ST-7 | 0.018 | 12 | 2.38 | A |
| 216 (Inv.) | (9) | 0.05 | ST-5, ST-7 | 0.017 | 10 | 2.39 | A |
| 217 (Inv.) | (17) | 0.05 | ST-5, ST-7 | 0.018 | 9 | 2.37 | A |
| 218 (Inv.) | (21) | 0.05 | ST-5, ST-7 | 0.020 | 14 | 2.40 | A |
| 219 (Inv.) | (23) | 0.05 | ST-5, ST-7 | 0.019 | 10 | 2.40 | A |
| 220 (Inv.) | (25) | 0.05 | ST-5, ST-7 | 0.018 | 12 | 2.39 | A |
| 221 (Inv.) | (26) | 0.05 | ST-5, ST-7 | 0.017 | 9 | 2.38 | A |
| 222 (Inv.) | (29) | 0.05 | ST-5, ST-7 | 0.019 | 13 | 2.39 | A |
| 223 (Inv.) | (33) | 0.05 | ST-5, ST-7 | 0.017 | 12 | 2.36 | A |
| 224 (Inv.) | (35) | 0.05 | ST-5, ST-7 | 0.020 | 12 | 2.39 | A |
| 225 (Inv.) | (36) | 0.05 | ST-5, ST-7 | 0.018 | 14 | 2.38 | A |
| 226 (Inv.) | (37) | 0.05 | ST-5, ST-7 | 0.019 | 10 | 2.39 | A |
| 227 (Inv.) | (39) | 0.05 | ST-5, ST-7 | 0.017 | 11 | 2.36 | A |
| 228 (Inv.) | (40) | 0.05 | ST-5, ST-7 | 0.020 | 12 | 2.39 | A |
| 229 (Inv.) | (42) | 0.05 | ST-5, ST-7 | 0.018 | 10 | 2.40 | A |
| 230 (Inv.) | (44) | 0.05 | ST-5, ST-7 | 0.018 | 11 | 2.40 | A |
| 231 (Inv.) | (45) | 0.05 | ST-5, ST-7 | 0.020 | 11 | 2.38 | A |

TABLE 4-continued

| Sample No. | Yellow coupler | Antistain* agent/yellow coupler | Dye image stabilizer | Color fog | Fading (%) | Maximum color density | color reproducibility |
|---|---|---|---|---|---|---|---|
| 232 (Inv.) | (47) | 0.05 | ST-5, ST-7 | 0.017 | 13 | 2.38 | A |

*Molar ratio

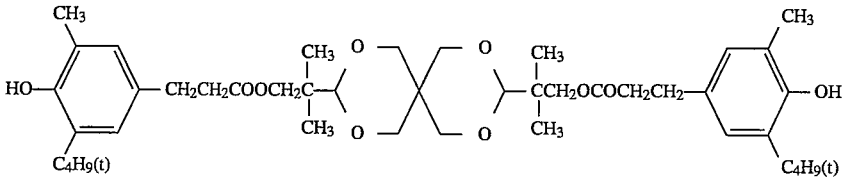

ST-5

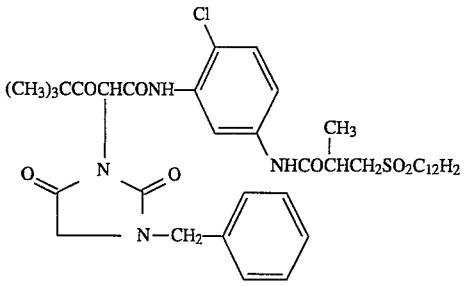

Y-2 p-t-Octylphenyl ST-6
Di-(2-dodecyloxycarbonylethyl)-sulfide ST-7
Compound PD-1 described in JP Application No. 11891/1993.

As is apparent from Table 4, the use of the antistain agent/yellow coupler ratio within the range for the invention enables to sufficiently inhibit color fog without bringing about deterioration of the resistance to light and lowering of the maximum density.

It is apparent from the comparison of Samples 206 to 210 that the overall characteristics including the light resistance and the maximum color density thereof are satisfactory when the antistain agent/coupler ratio is in the range of 2 to 4 mol %.

Further, it is apparent that the effect of the invention can be obtained even when the yellow coupler is changed. Above all, the samples in which the coupler represented by Formula I is used have satisfactory color reproducibility and exhibit largely the effect of the invention.

Example 3

Preparation of blue-sensitive silver halide emulsion

Emulsions EM-A to EM-F were prepared in the same manner as in the emulsion EMP-1 except that the $K_2IrCl_6$ and $K_4Fe(CN)_6$ in Solution C in Example 1 were changed as shown below:

| Emulsion | Substitute for $K_2IrCl_6$ | Substitute for $K_4Fe(CN)_6$ |
|---|---|---|
| EM-A | $K_2IrCl_6$ | $K_4Ru(CN)_6$ |
| EM-B | $K_2IrBr_6$ | $K_4Os(CN)_6$ |
| EM-C | $K_2IrCl_6$ | $PbNO_3$ |

-continued

| Emulsion | Substitute for $K_2IrCl_6$ | Substitute for $K_4Fe(CN)_6$ |
|---|---|---|
| EM-D | $K_2IrBr_6$ | $KInCl_3$ |
| EM-E | $K_2IrBr_6/K_2IrCl_6$ (Equimolar mixture) | $GaNO_3$ |
| EM-F | $K_2IrBr_6/K_2IrCl_6$ (Equimolar mixture) | $GeNO_3$ |

The above emulsions EM-A to EM-F were chemically sensitized in the same manner as in the blue-sensitive silver halide emulsion of Example 1 to thereby obtain Emulsions EM-a to EM-f, respectively.

Preparation of green-sensitive silver halide emulsion

Emulsions EM-G to EM-L were prepared in the same manner as in the emulsion EMP-1 of Example 1 except that the $K_2IrCl_6$ and $K_4Fe(CN)_6$ of Solution C were changed as follows:

| Emulsion | Substitute for $K_2IrCl_6$ | Substitute for $K_4Fe(CN)_6$ |
|---|---|---|
| EM-G | $K_2IrCl_6$ | $K_4Ru(CN)_6$ |
| EM-H | $K_2IrCl_6$ | $K_4Os(CN)_6$ |
| EM-I | $K_2IrCl_6$ | $PbNO_3$ |
| EM-J | $K_2IrBr_6$ | $KInCl_3$ |
| EM-K | $K_2IrBr_6/K_2IrCl_6$ | $GaNO_3$ |

-continued

| Emulsion | Substitute for $K_2IrCl_6$ | Substitute for $K_4Fe(CN)_6$ |
|---|---|---|
| EM-L | (Equimolar mixture) $K_2IrBr_6/K_2IrCl_6$ (Equimolar mixture) | $GeNO_3$ |

The above emulsions EM-G to EM-L were chemically sensitized in the same manner as in the green-sensitive silver halide emulsion of Example 1 to thereby obtain Emulsions Em-g to Em-l, respectively.

Preparation of red-sensitive silver halide emulsion

The following red-sensitive silver halide emulsions were prepared in the same manner as in the red-sensitive silver halide emulsion of Example 1 except that the emulsion used, the sensitizing dyes and the supersensitizers used in Example 1 were replaced by those given below:

| Red-sensitive emulsion | Emulsion used | Sensitizing dye | Supersensitizer |
|---|---|---|---|
| EmR-11 | EM-G | RS-1 | RSS-1 |
| EmR-12 | EM-G | RS-2 | RSS-2 |
| EmR-13 | EM-G | RS-3 | RSS-3 |
| EmR-14 | EM-H | RS-4 | RSS-4 |
| EmR-15 | EM-H | RS-1 | RSS-3 |
| EmR-16 | EM-H | RS-3 | RSS-5 |
| EmR-17 | EM-I | RS-2 | RSS-4 |
| EmR-18 | EM-J | RS-3 | RSS-2 |
| EmR-19 | EM-K | RS-2 | RSS-2 |
| EmR-20 | EM-K | RS-3 | RSS-3 |
| EmR-21 | EM-K | RS-4 | RSS-3 |
| EmR-22 | EM-L | RS-1 | RSS-5 |
| EmR-23 | EM-L | RS-2 | RSS-2 |
| EmR-24 | EM-L | RS-4 | RSS-4 |

RS-2

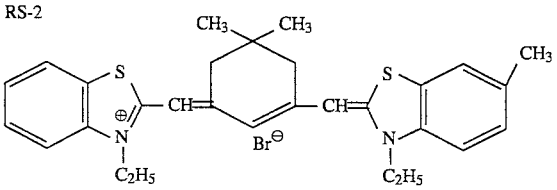

RS-3

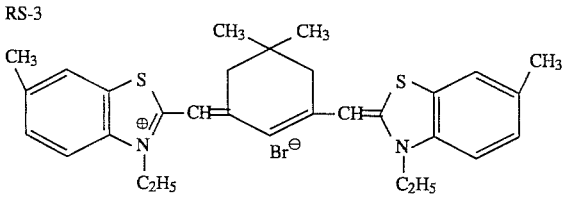

RS-4

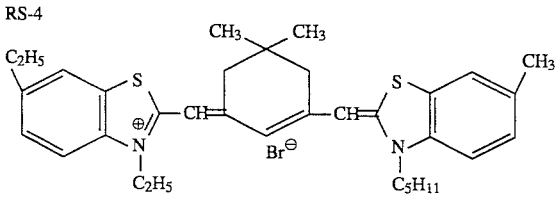

-continued

RSS-2

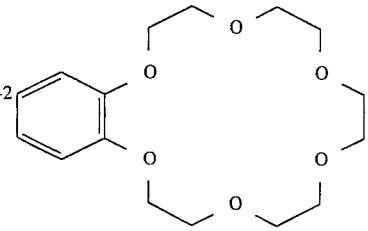

RSS-3

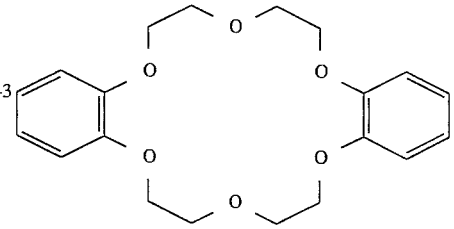

RSS-4

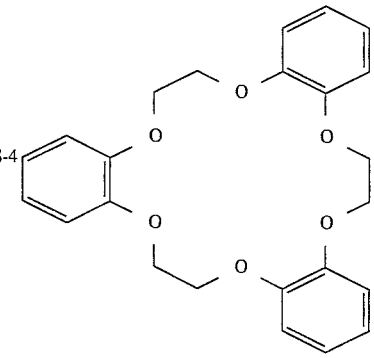

RSS-5 A condensate of

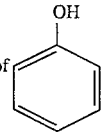

and

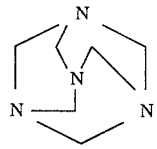

Samples were prepared in the same manner as in Example 1 except that the blue-sensitive emulsion Em-B of Example 1 was replaced by Emulsions Em-a to Em-f, the green-sensitive emulsion Em-G was replaced by Emulsions Em-g to Em-l, and the red-sensitive emulsion Em-R was replaced by Emulsions EmR-11 to EmR-14.

These emulsions were examined and evaluated in the same manner as Example 1. As a result, it was confirmed that the results of the samples show better the effect of the invention.

Example 4

Samples were prepared in the same manner as in Example 1 except that two kinds of monodisperse emulsions different in the grain diameter and exposure characteristics were applied in combination to the blue-sensitive, green-sensitive and red-sensitive emulsions of the sample in Example 1, and the samples were subjected to the same experiments and evaluations as in Example 1. Then, it was confirmed that the results of the samples show better the effect of the invention.

Example 5

Each sample that was used in Example 1 was used to be subjected to similar evaluations to the above by using a minilab system processor. The device used was a KONICA NICE PRINT SYSTEM 602QA and the processing solutions used therein were KONICA. MINILAB COLOR PAPER PROCESS CPK2-20 (CPK-20QA-M) comprised of Developer replenisher 20P-1, Developer starter 20P-1S, Bleach-fix & replenisher 20P-2 and SuperStabilizer & replenisher 20P-2. The processed negatives used therefor were KONICA Impressa 50, SuperDD100 and Fuji Reara. Prior to getting down to tests, each printing light-sensitive material of the invention was used to be subjected to running processing that lasted until the respective total replenished amounts in the baths of the processor come to 3 times the initial quantities of the solutions in the baths. And separately from this, running processing was made likewise with use of KONICA Color QA Paper Type A prior to the tests. The tests and evaluations were conducted in the same manner as in Example 1, and as a result, it was confirmed that the results of the samples, even in the above tests, showed better the effect of the invention.

Example 6

Example 2 was repeated in the same way except that the processing was changed as shown below:

Evaluation was made in the same manner as in Example 1, and it was confirmed that the results showed better the effect of the invention.

| Processing step | Temperature | Time | Repl. amt. |
|---|---|---|---|
| Color developing | 38.0 ± 0.3° C. | 25 seconds | 81 ml |
| Bleach-fix | 35.0 ± 0.5° C. | 25 seconds | 54 ml |
| Stabilizing | 30 to 34° C. | 25 seconds | 150 ml |
| Drying | 60 to 80° C. | 30 seconds | |

The compositions of the processing solutions are as follows:

| | Tank solution | Replenisher |
|---|---|---|
| Color developer tank solution and replenisher | | |
| Pure water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methansulfonamidoethyl)-3-methyl-4-aminoaniline sulfate | 6.5 g | 10.5 g |
| N,N-diethylhydroxylamine | 3.5 g | 6.0 g |
| N,N-bis(2-sulfoethyl)hydroxyamine | 3.5 g | 6.0 g |
| Triethanolamine | 10.0 g | 10.0 g |
| Sodium diethylenetriaminepentaacetate | 2.0 g | 2.0 g |
| Brightening agent, 4,4'-diaminostilbene-diphosphonic acid derivative | 2.0 g | 2.5 g |
| Yotassium carbonate | 30 g | 30 g |
| Water to make | 1 liter | 1 liter |
| Adjust pH to | 10.0 | 10.60 |
| Bleach-fix tank solution and replenisher | | |
| Ferric ammonium diethylenetriamine-pentaacetate, dehydrate | 100 g | 50 g |
| Diethylenetriaminepentaacetic acid | 3 g | 3 g |
| Ammonium thiosulfate (70% solution) | 200 ml | 100 ml |
| 2-Amino-5-mercapto-1,3,4-thiadiazole | 2.0 g | 1.0 g |
| Ammonium sulfite (40% solution) | 50 ml | 25 ml |
| Water to make | 1 liter | 1 liter |
| Potassium carbonate or glacial acetic acid to adjust pH to | 7.0 | 6.5 |
| Stabilizing solution and replenisher | | |
| o-Phenylphenol | 1.0 g | |
| 5-Chloro-2-methyl-4-isothiazoline-3-one | 0.02 g | |
| 2-Methyl-4-isothiazoline-3-one | 0.02 g | |
| Ethylene glycol | 1.0 g | |
| Brightening agent (Cinopal SFP) | 2.0 g | |
| 1-Hydroxyethylidene-1,1-diphosphonic acid | 1.8 g | |
| PVP | 1.0 g | |
| Ammonia water (ammonium hydroxide 25% sol.) | 2.5 g | |
| Ethylenediaminetetraacetic acid | 1.0 g | |
| Ammonium sulfite (40% solution) | 10 ml | |
| Water to make 1 liter | | |
| Adjust pH to 7.5 with sulfuric acid or ammonia water. | | |

Example 7

An electron beam setting coating liquid having the following composition was prepared.

| A coating liquid comprising | |
|---|---|
| urethane acrylate resin | 25%, |
| epoxy acrylate resin | 25% and |
| titanium dioxide (anataze type) | 50% |

was coated by using a slit-orifice coater so as to have a coating weight (solid matter) of 6 g/m$^2$ on the peripheral surface of a rotary drum having a high-gloss mirror-like periphery in revolution at a line speed of 30 m/min; onto the coated liquid layer was pressingly applied a photographic paper support paper weighing 175 g/m$^2$ moving interlockingly with the drum revolving speed; and the liquid layer is subjected through the paper to the irradiation of an electron beam at an acceleration voltage of 175 kV so as to make an absorption dose of 1 Mrad, which is made from the back of the paper, to thereby harden the coated liquid layer, and thus the above layer-laminated paper support was peeled apart from the drum.

A sample was prepared in the same manner as in Example 1 except that the above prepared paper support was used in place of the support in Example 1.

The above obtained sample was examined and evaluated in the same way as in Example 1. Then, it was confirmed that the results showed better the effect of the invention.

What is claimed is:

1. A silver halide photographic light-sensitive material comprising a support having provided thereon a plurality of silver halide emulsion layers, wherein a silver halide emulsion layer at a position closest to said support contains an amount of a yellow dye-forming coupler represented by Formula XX, and a compound represented by Formula HQ-I in an amount of 2 mol % to 4 mol %, based on said amount of said yellow dye-forming coupler, an at least one layer of said silver halide photographic light-sensitive material contains an antimold agent represented by Formula XXI;

(HQ-I)

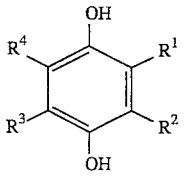

wherein $R^1$, $R^2$, $R^3$ and $R^4$ are each independently hydrogen, halogen, alkyl, alkenyl, aryl, cycloalkyl, alkoxy, aryloxy, alkylthio, arylthio, acyl, alkylacylamino, arylacylamino, alkylcarbamoyl, arylcarbamoyl, alkylsulfonamido, arylsulfonamido, alkylsulfamoyl, arylsulfamoyl, alkylsulfonyl, arylsulfonyl, nitro, cyano, alkoxycarbonyl, aryloxycarbonyl, alkylacyloxy or arylacyloxy, the above groups represented by $R^1$, $R^2$, $R^3$, and $R^4$ may have a substituent, provided that at least one of $R^1$ and $R^3$ is a group having 6 or more carbon atoms in total including any substituent thereof, (XX)

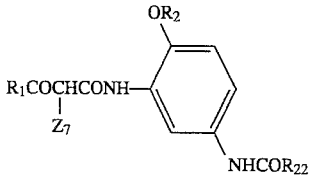

wherein $R_1$ is alkyl or cycloalkyl; $R_2$ is alkyl, cycloalkyl or aryl; $R_{22}$ is a straight chain unsubstituted alkyl having 11 to 21 carbon atoms; and $Z_7$ is a group represented by Formula XII provide that the molecular weight thereof is not greater than 128 in the state of a compound represented by Formula XII';

(XII)

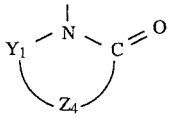

(XII')

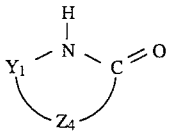

wherein $Y_1$ is —N($R_{12}$)—, in which $R_{12}$ is hydrogen, alkyl, aryl, a heterocyclic, —O—, —S(O)$_r$—, in which r is 0, 1 or 2, —CO— or —C($R_{13}$)($R_{14}$)— in which $R_{13}$ and $R_{14}$ are each hydrogen, alkyl, halogen, cyano, nitro, aryl, hydroxyl, alkoxy, aryloxy, a heterocyclic carbonyloxy, sulfonyloxy, carbonyl, oxycarbonyl, carbamoyl, sulfonyl, sulfamoyl, amino sulfonamido, acylamino, alkylthio, arylthio, or a heterocylic thio; $Z_4$ is a group of non-metal atoms necessary to form a five- or six-member ring together with the —$Y_1$—N—CO— group, (XXI)

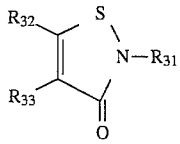

wherein $R_{31}$ is hydrogen, alkyl, cycloalkyl, alkenyl, aralkyl, aryl, alkoxyl, —CONHR in which R is alkyl, aryl, alkylthio, arylthio, alkylsulfonyl, or arylsulfonyl, or a heterocyclic; $R_{32}$ and $R_{33}$ each independently represents hydrogen, halogen, alkyl, cycloalkyl, aryl, a heterocyclic, cyano, alkylthio, arylthio, alkylthiosulfoxide, alklysulfonyl, alkylsulfinyl; $R_{32}$ and $R_{33}$ may combine to form a benzene ring which may have a substituent.

2. The light-sensitive material of claim 1, wherein said compound represented by Formula HQ-I is a compound represented by Formula HQ-II;

(HQ-II)

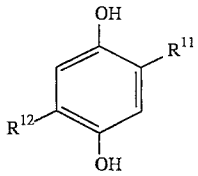

wherein $R^{11}$ and $R^{12}$ are each independently a hydrogen atom, an alkyl group, an alkenyl group, an aryl group, an acyl group or a cycloalkyl group, provided that at least one of $R^{11}$ and $R^{12}$ is a group having 6 or more carbon atoms.

3. The light-sensitive material of claim 1, wherein said silver halide emulsion layer provided at the position closest to the support contains said yellow dye-forming coupler in an amount of not more than 0.75 g/m$^2$.

4. The light-sensitive material of claim 3, wherein said silver halide emulsion layer provided at the position closest to the support contains said yellow dye-forming coupler in an amount of not more than 0.71 g/m$^2$.

* * * * *